US012378045B2

(12) United States Patent
Knutsen et al.

(10) Patent No.: US 12,378,045 B2
(45) Date of Patent: Aug. 5, 2025

(54) DEVICE AND METHOD FOR HANDLING A SEALING DEVICE

(71) Applicant: SMARTSEAL AS, Stavanger (NO)

(72) Inventors: Rune Kristian Knutsen, Stavanger (NO); Jeroen Gerrit Anton Gebbink, Helmond (NL)

(73) Assignee: SMARTSEAL AS, Stavanger (NO)

( * ) Notice: Subject to any disclaimer, the term of this patent is extended or adjusted under 35 U.S.C. 154(b) by 710 days.

(21) Appl. No.: 17/622,223

(22) PCT Filed: Jun. 29, 2020

(86) PCT No.: PCT/EP2020/068284
§ 371 (c)(1),
(2) Date: Dec. 22, 2021

(87) PCT Pub. No.: WO2020/260706
PCT Pub. Date: Dec. 30, 2020

(65) Prior Publication Data

US 2022/0348385 A1 Nov. 3, 2022

(30) Foreign Application Priority Data

Jun. 28, 2019 (NL) ..... 2023401

(51) Int. Cl.
*B65D 47/24* (2006.01)
*B65D 75/58* (2006.01)

(52) U.S. Cl.
CPC ..... *B65D 47/248* (2013.01); *B65D 75/5883* (2013.01)

(58) Field of Classification Search
CPC ..... B65D 75/5883; B65D 47/248
(Continued)

(56) References Cited

U.S. PATENT DOCUMENTS 6,871,764 B2 * 3/2005 Stoneberg ..... B65D 51/18 222/548
2009/0036865 A1 * 2/2009 Moy ..... A61J 1/2089 604/416

FOREIGN PATENT DOCUMENTS

EP 2040991 B1 12/2016
WO 2008/016307 A1 2/2008
WO 2020260709 A1 12/2020

OTHER PUBLICATIONS

International Searching Authority; International Search Report for international patent application PCT/EP2020/068284, Written Opinion of the International Searching Authority for international patent application PCT/EP2020/068284, and notification of transmittal of the international search report and the written opinion of the international searching authority; mailing date Oct. 7, 2020, 13 pages.

* cited by examiner

*Primary Examiner* — Robert F Long
*Assistant Examiner* — Xavier A Madison
(74) *Attorney, Agent, or Firm* — McDonnell Boehnen Hulbert & Berghoff LLP

(57) ABSTRACT

The disclosure relates to a device (100) and method for handling a sealing device (1) in order to position the discharge pipe (10) of a valve (4) of the sealing device into a storage position. The handling device comprises a cap support (150) to be arranged at the downstream side of the protective cap (61) and configured to support the protective cap, and a pushing device (120) arranged at the upstream side of the base and configured to apply a first pushing force on the base (3) and/or valve housing (25) so to urge the base, valve and protective cap against the cap support and to apply a second pushing force on the discharge pipe of the valve to urge the discharge pipe to its storage position.

23 Claims, 16 Drawing Sheets

(58) Field of Classification Search
USPC ..... 53/285
See application file for complete search history.

DEVICE AND METHOD FOR HANDLING A SEALING DEVICE

BACKGROUND

The present disclosure relates to a method and device for handling a sealing device. The disclosure also relates to an assembly comprising a handling device and one or more sealing devices.

The sealing device is of a type that is configured to seal a receptacle such as a spout of a spouted pouch container, a container as such, for instance a bottle, carton, cup or a can, or similar holder for keeping drinkable (carbonated or non-carbonated) liquids. The sealing device may be configured to open and close a discharge opening of the receptacle. More generally, the sealing device may comprise a base structured to be mounted to the receptacle, the base comprising a sleeve forming a discharge conduit, a valve including a valve housing arranged on the base, wherein when the base is mounted to the receptacle, the receptacle is located upstream of the valve and the discharge direction of the receptacle defines a downstream direction, opposite an upstream direction, wherein the valve further comprises a discharge pipe at least partially protruding in the sleeve of the base and being axially movable therein in the upstream and downstream direction between a storage position wherein the valve is closed and one more utility positions wherein the valve is closed or opened, and a protective cap to be placed on the base and/or valve for protecting the valve.

In EP 2 040 991 B1 a sealing device is described that is structured to be able to arranged in different modes or positions: an open utility position, in which the valve of the sealing device is open, a closed utility position, in which the valve of the sealing device is closed in a normal manner (with the sealing device in use), and a closed storage position wherein the valve is more firmly closed than in the normal manner, in order to ensure that the likelihood of the valve remaining closed is increased. The known sealing device provides a gas-tight sealing in the (closed) storage position (whereas in the closed utility position the sealing needs to be liquid-tight only). The closed storage position is in the present disclosure also simply referred to as the storage position. The closed storage position is in the present disclosure also simply referred to as the storage position. For instance, the valve may be arranged in the closed storage position when the sealing device is stored or transported between the manufacturing site and the filling site. Alternatively or additionally, the sealing device may be kept in the storage position right after the sealing device has been connected to a receptacle and the receptacle has been filled with content, for instance during transportation thereof from the assembly site to the store, and before the sealing device has been opened for the first time by the end user.

EP 2 040 991 B1 further discloses that the sealing device is structured so that in the storage mode/position, the sealing functions as a good seal in connection with filling, packing, transport and storage of a beverage in a (drinking) receptacle. In the closed utility mode/position, the sealing device is also structured to function as a good seal in connection with consumption of the beverage in the drinking receptacle, hereinafter termed a utility seal. Upon consumption, the valve is normally opened and closed repeatedly, and the sealing device is therefore structured to be able to function satisfactorily also in context of this type of application.

However, in the known sealing device the situation may occur that when the receptacle is to be filled with liquid and subsequently be transported, the valve should be in the storage position. Otherwise there is a small risk that the receptacle with sealing device is not completely liquid tight. For instance, in exceptional circumstances a small amount of liquid may leak from the sealing device during transport and storage of the filled receptacle.

It has been found by the inventors that the risk of leakage of the sealing device after the receptacle to which the sealing device is connected, has been filled with content can be reduced further if it is ensured that the valve is in the above-mentioned closed storage position and that transport and/or storage of the receptacle when the sealing device is not in the closed storage position (i.e. in the open utility position or closed utility position), should be avoided.

Furthermore, the valve, seat and cap may be manufactured remotely from the location where the sealing device is attached to the receptacle and/or from the location where the receptacle is filled. For instance, the valve and seat of the sealing device may be manufactured as one common sealing unit at a first geographical location, whereas the sealing device is assembled by placing the cap on the sealing unit only at a second geographical location. This requires transportation from the first to the second location. During transport (and possibly also storage) the valve in the sealing unit may be unintentionally become displaced so that it cannot be guaranteed that the sealing device is still in the storage position when it arrives at the second geographical location and remains in the storage position during further handling at the second location.

Overview

It is an object of the present disclosure to provide a method and device for handling a sealing device wherein the one or more of the above disadvantages have been reduced or even removed.

It may also be an object of the present disclosure to provide a method and device for handling a sealing device wherein the likelihood of leakage is reduced.

It may be an object of the present disclosure to provide a method and device for handling a sealing device that enable an efficient assembly of the sealing device.

It may be an object of the present disclosure to provide a method and device for positioning the valve of a sealing device in a reliable manner into a fully closed position.

At least one object may at least partially be achieved in a handling device for handling a sealing device for sealing a receptacle. The sealing device may be of the type comprising:

- a base structured to be mounted to the receptacle, the base comprising a sleeve forming a discharge conduit;
- a valve including a valve housing arranged on the base, wherein when the base is mounted to the receptacle, the receptacle is located upstream of the valve and the discharge direction of the receptacle defines a downstream direction, opposite an upstream direction, wherein the valve further comprises a discharge pipe at least partially protruding in the sleeve of the base and being axially movable therein in the upstream and downstream direction between a storage position wherein the valve is closed and one more utility positions wherein the valve is closed or opened. The handling device may be configured to position the discharge pipe of the valve of the sealing device into a storage position, the handling device comprising:

a support arranged or to be arranged at the downstream side of the base and configured to support the handling device;

a pushing device arranged or to be arranged at the upstream side of the base and configured to apply a first pushing force on the base and/or on the valve housing so to urge at least the base and the valve against the support and to apply a second pushing force on the discharge pipe of the valve to urge the discharge pipe to its storage position.

The handling device may be configured to apply a second force on the discharge pipe that is larger or smaller than the first force applied to the base and/or valve housing. Furthermore, the pushing device may be configured to apply the first force on the base independently from applying the second force on the discharge pipe. This may cause displacement of the discharge pipe independently from the displacement of the base.

Urging by the second pushing force might result in displacement of the discharge pipe in the downstream direction relative to the valve housing and the base in case the discharge pipe originally was not already in the storage position.

The pushing device is able to apply both a first pushing force on the base thereby pressing the base and valve (and on some embodiments also on a protective cap) together and position them at a predetermined fixed position against the support and apply a second pushing force on the movable discharge pipe of the valve in order to guarantee that the (discharge pipe of the) valve will be in the closed storage position.

In case the sealing device has no protective cap, the support is a valve support configured to support the valve. The valve support may for instance be configured to contact a clamping ring and/or a valve collar of the sealing device, as will be explained later. In case the sealing device does have a protective cap, the support is a cap support configured to support the protective cap, as will later be explained as well.

It is noted here that the pushing forces exerted on the sealing device may be accomplished by moving the (portions of the) pushing device towards the sealing device while keeping the support stationary. In other embodiments, however, the pushing forces exerted on the sealing device are accomplished by keeping portions of the pushing device stationary while the support is moved towards the sealing device. In still other embodiments both the (portions of the) pushing device and the support are moved towards each other.

Furthermore, since both the position of the valve housing pushed by the pushing device and the dimensions of the sealing device are a priori known, the right storage position of the discharge pipe is known as well, enabling the pushing device to push against the discharge pipe until exactly the right position has been reached. The handling device may provide such a high positioning accuracy of the discharge pipe relative to the base and the valve housing that there is no need for sensors and the like for determining the positions of the base and/or valve, before or after the pushing operation, in order to determine exactly the right storage position. The handling device may have a relatively simple and reliable construction and may enable a very high handling speed.

In embodiments of the present disclosure the protective cap remains unattached: applying the first force on the base is only performed to ensure that the base, valve and cap are aligned so to be able to more accurately bring the valve into the storage position. In other embodiments the first force is alternatively or additionally applied to automatically attach the protective cap to the valve and/or base, for instance if the protective cap comprise one or more snap fitting elements. The cap is attached/locked to the base/valve by sliding it over the base/valve assembly, the protective cap will have a feature that will fit to the valve collar. While pressing downwards the valve collar will be compressed and a snap detail in the protective cap will snap under the base collar. The interface between the protective cap and the valve top side, will then create a pretention on the snap and a seal between the cap-valve and base, as the valve is of a soft material.

Therefore the handling device may be configured to both attach the protective cap to the valve and/or base and position the valve into the storage position. Preferably the attaching and positioning is performed simultaneously. For instance, when the base and valve have already been connected to each other to form a common sealing unit in a previous manufacturing operation, the pushing device may be able to attach the protective cap to the sealing unit in a further manufacturing operation (which may be performed at a different geographical location than the previous manufacturing operation). At the same time it is ensured that the valve in the resulting sealing device (i.e. a sealing device having a base, valve and protective cap) is in the storage position. The sealing device is then in the right condition to be attached to a receptacle to be filled with content.

In an embodiment of the present disclosure the pushing device is configured to apply a second force on the discharge pipe that is larger than the first force applied to the base and/or valve housing. As will be explained hereafter, in embodiments wherein use is made of a resilient member such as a compression spring, the first force will primarily be determined by the spring constant of the compression spring, while the second force (which is applied essentially independently from the first force) will be determined by the drive driving the movement of the pushing device.

The sealing device may be of a type wherein the discharge pipe is configured to be axially movable between a storage position wherein the discharge pipe has been moved in downstream direction to contact a storage seal seat of the sleeve to close the discharge conduit, an open utility position wherein the discharge pipe has been moved in upstream direction to open the discharge conduit, and a closed utility position, arranged between the storage position and the open utility position, wherein the discharge pipe has been moved to contact a utility seal part of the sleeve to close the discharge conduit. When the sealing device is of this type, the handling device may be configured to move the discharge pipe from the open utility position to the storage position (via the closed utility position) or from the closed utility position to the storage position.

In embodiments of the present disclosure the valve and base are configured to allow movement of the discharge pipe between a closed storage position and a closed utility position in which the valve is closed in a more firm manner in the closed storage position than in the closed utility position. In the closed storage position the valve is closed in order to ensure that the likelihood of the valve remaining closed during handling, i.e. during transport and/or storage, is increased.

In case the discharge pipe of the sealing device comprises an upstream seal member, the handling device, for instance a first pushing element of the pushing device of the handling device, may be configured to contact the upstream seal member and to move the upstream seal member in downstream direction until the discharge pipe reaches its storage position. More generally, the pushing device may comprise:

- a first pushing element comprising a first contact surface to be placed against the discharge pipe, for instance against the upstream seal member of the discharge pipe;
- a second pushing element comprising a second contact surface to be placed against the base;
- wherein the first and second pushing elements are configured to be displaced relative to each other in the axial direction.

The first pushing element may be configured to apply a pushing force only on the movable discharge pipe of the valve (i.e. directly or indirectly), while the second pushing element is configured to apply a force only on the stationary base and/or the stationary parts of the valve (i.e. on the housing of the valve).

As referred to above, the drive of the handling device is configured to both drive the movement of the first pushing element and drive the movement of the second pushing element. In principle the first pushing element can be displaced independently from the second pushing element. In certain embodiments the drive comprises a first drive unit for driving the movement of the first pushing element and a (separate) second drive unit for driving the movement of the second pushing element, independently from driving the first pushing element. Alternatively or additionally, the drive may comprise:

- a first drive unit for driving the movement of the first pushing element;
- at least one resilient member, for instance a compression spring or similar resilient element, connected between the first and second pushing element and configured to move the second pushing element along with the movement of the first pushing element. This allows the handling device to simply use one single drive unit to drive the first pushing element in a direct manner and the second pushing element in an indirect manner, while still ensuring a suitable amount of force to be exerted on the base and valve, respectively.

In one of the embodiments of the present disclosure the drive is configured to:

- in a first stage, have the second pushing element co-move with the axial movement in downstream direction of the first pushing element until the second pushing elements abuts the base;
- in a second stage, have the second pushing element apply a pushing force on the base to arrange the base, valve and protective cap against each other and urge the protective cap against the cap support, while continuing moving the first pushing element in the downstream direction;
- in a third stage, have the first pushing element start pushing against the discharge pipe of the valve so to bring the discharge pipe into the storage position.

In embodiments of the present disclosure the first pushing element of the handling device comprises an elongated pushing rod and the second pushing element comprises a tube that is arranged concentrically around the pushing rod. The first and second pushing elements are configured to be axially movable relative to each other. In one of these embodiments the second pushing element is spring loaded on the first pushing element. The first and second pushing element can independently from each other exert a force on one or more particular portions of the base and the valve. The first pushing element may be formed by one piece of material. In other embodiments the first pushing element comprises a first pushing rod part and an exchangeable second pushing rod part. The second pushing rod part generally is aligned with the first pushing rod part and may be removably attached to the first pushing rod part. Furthermore, two or more exchangeable second pushing rod parts may be provided, each of the second pushing rod parts having a different contact surface adapted to the shape of a different discharge pipe, for instance adapted to the upstream seal member of the valve. The contact surface of the first pushing element can therefore be tailored for the specific type of sealing device.

The sealing device may be placed on the handling device in different manners. Means for positioning the sealing device on the handling device, i.e. between the pushing device and cap support, may be provided, for example an assembly-line, a conveyor, an automated system, a manual system or the like.

According to a further aspect of the present disclosure an assembly of a handling device and at least one sealing device as defined herein is provided.

According to a still further aspect of the present disclosure a method of handling a sealing device in a handling device is provided, wherein the method comprises:

- placing the sealing device between a cap support and a pushing device of the handling device;
- applying a first pushing force on the base and/or valve housing of the sealing device so to urge the base, valve and protective cap against the cap support;
- applying a second pushing force on the discharge pipe of the valve to urge the discharge pipe to its storage position.

The method may comprise attaching a protective cap to the valve and/or base and position the valve into the storage position.

The method may comprise applying a second force on the discharge pipe that is larger than the first force applied to the base and/or valve housing.

In embodiments wherein when the discharge pipe of the sealing device is configured to be axially movable between a storage position wherein the discharge pipe has been moved in downstream direction to contact a storage seal seat of the sleeve to close the discharge conduit, an open utility position wherein the discharge pipe has been moved in upstream direction to open the discharge conduit, and a closed utility position, arranged between the storage position and the open utility position, wherein the discharge pipe has been moved to contact a utility seal part of the sleeve to close the discharge conduit, the method may comprise moving the discharge pipe from the open utility position or the closed utility position to the storage position.

In embodiments wherein the discharge pipe comprises an upstream seal member, the method may comprise contacting the upstream seal member and moving the upstream seal member in downstream direction until the discharge pipe reaches its storage position.

In embodiments wherein the pushing device comprises a first pushing element comprising a first contact surface and a second pushing element comprising a second contact surface, the method may comprise moving the second pushing element towards the base of the sealing device and having the second contact surface of the second pushing element apply a pushing force against the base; and moving the first pushing element towards the discharge pipe of the sealing device and having the first contact surface of the first pushing element apply a pushing force against the discharge pipe.

The method may further comprise driving the movement of the first pushing element and the second pushing element using a drive connected to the pushing device and/or driving the movement of the first pushing element independently from driving the movement of the second pushing element. Furthermore, the method may comprise aligning the base and the valve housing by applying the first pushing force.

BRIEF DESCRIPTION OF THE DRAWINGS

Further advantages, features and details of the present disclosure will be elucidated with reference to the description of some examples thereof. Reference is made in the description to the accompanying figures. The figures are schematic and may be somewhat distorted with respect to relative dimensions and position of components relative to one another. In general, similar or corresponding details of the figures will be given the same or similar reference numerals in the following.

DETAILED DESCRIPTION

In the following description, for the purposes of explanation, numerous specific details are set forth in order to provide a thorough understanding of the present invention. It will be apparent, however, that the present invention may be practiced without these specific details. In other instances, well-known structures and devices are not described in exhaustive detail, in order to avoid unnecessarily obscuring the present invention.

As will be apparent to those of skill in the art upon reading this disclosure, each of the individual embodiments described and illustrated herein has discrete components and features which may be readily separated from or combined with the features of any of the other several embodiments without departing from the scope of the present invention. Any recited method can be carried out in the order of events recited or in any other order which is logically possible.

It is noted that, as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

An example of a sealing device having a storage position to be used when the sealing device is stored, an open utility position to open the discharge passage of the sealing device and a closed utility position to close off the discharge passage of the sealing device is described in WO 2008/016307 A1, the content of which is herein incorporated by reference.

Figure 1:
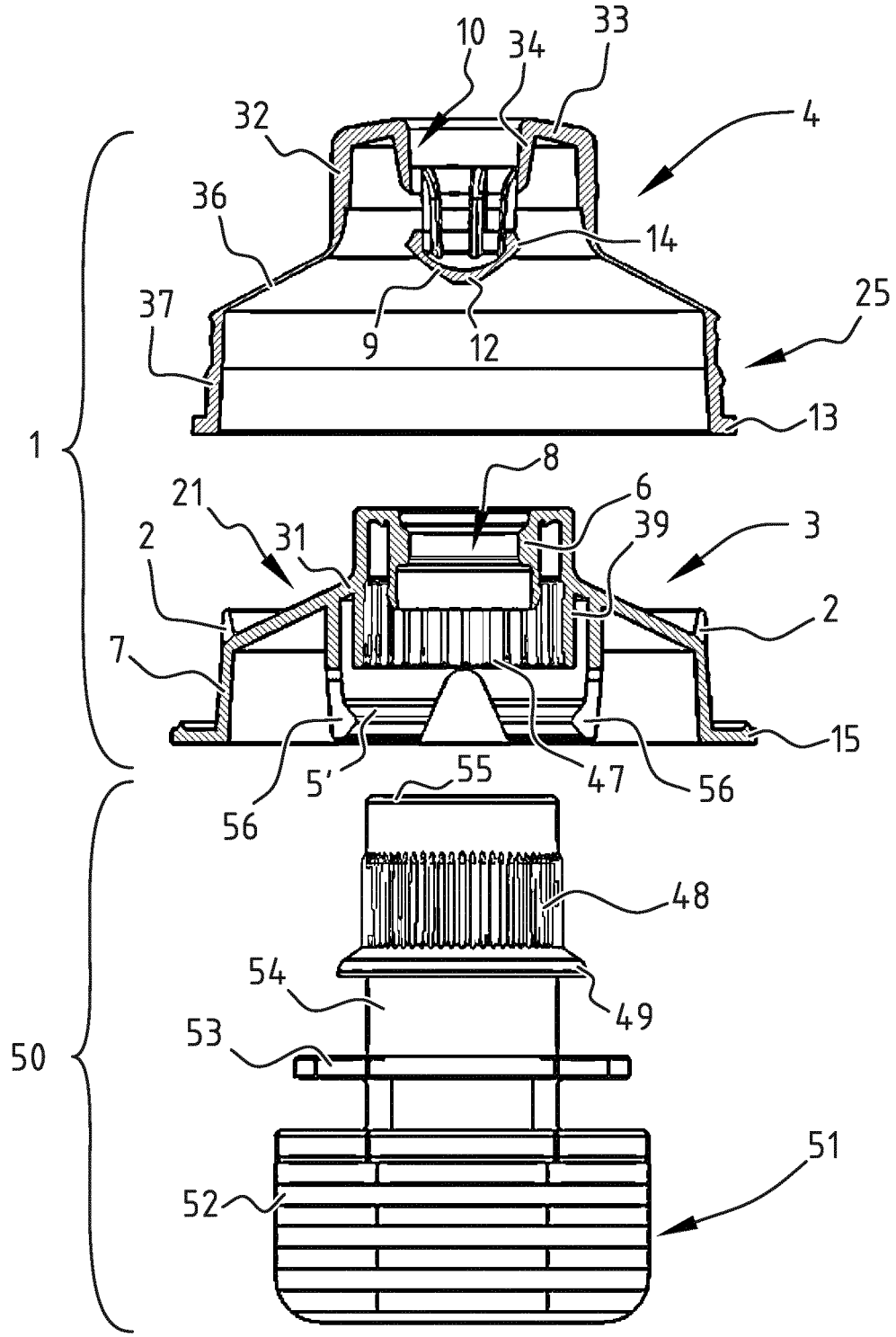
FIG. 1 is an exploded side view, partly cut away, of a first embodiment of a sealing device and on a (portion of a) receptacle.

FIG. 1 illustrates a schematic exploded view of an assembly of a receptacle 50 of a container (the container is not shown, but could be any container or holder able to carry a liquid or liquid-like medium, for instance a flexible spouted pouch container, a bottle, a can, a drinking carton, etc.) and a first embodiment of a sealing device 1 according to the present disclosure.

The sealing device 1 comprises a base 3 (to be) connected to the receptacle 50 and a valve 4 (to be) mounted to the base 3. The base 3 comprises a stationary base housing 21 comprising at least a wall partition 31 and a tubular base wall 7. In further embodiments, for instance the embodiment of FIGS. 2A-2C, the base housing 5 also comprises a tubular connection portion 11, while the base housing 5 may also comprise a cylindrical flange 39, as will be explained later. The base 3 also comprises a discharge conduit 8 in which a base passage (i.e. passage through the base 3) is provided. To this end the base housing 21 may comprise a tubular body 6 (herein also referred as a sleeve 6) as part of the discharge conduit 8.

Similarly, the valve 4 comprises a stationary valve housing 25 to be attached the base housing 21. The stationary valve housing 25 may comprise a tubular attachment wall 37 and a valve collar 13. The valve 4 also comprises a number of parts that are configured to be movable with respect to the stationary valve housing 25. For instance, the valve 4 comprises a discharge pipe 10 wherein a valve passage is provided. When the valve 4 is positioned on the base 3, the base passage in the discharge conduit of the base 3 and the valve passage in the discharge pipe of the valve 4 together form a closable or sealable passage from the interior of the (container of a) receptacle 50 connected to the sealing device 1 and the exterior, allowing any contents of the container to be dispensed, as will be explained hereafter.

In the shown embodiments, the wall partition 31 extends at least partially radially with respect to the discharge conduit 8. Connected to the wall partition 31 or integrally formed therewith are three concentric axial tubular walls: a tubular base wall 7 with a relatively large diameter, a cylindrical flange 39 having a small diameter, and a ring-shaped connection portion 56 having an intermediate diameter (i.e. a diameter larger than the diameter of the cylindrical flange 39 and smaller than the diameter of the tubular base wall 7). The base 3 further comprises a base collar 15 formed by a generally ring-shaped radially protruding portion of the tubular base wall 7 of the base 3. The base collar 15 is preferably arranged at the upstream free end of the tubular base wall 7.

The valve 4 further comprises an outer tubular wall 32 connected via a top wall 33 to an inner tubular wall 34 of the discharge pipe 10. The outer tubular wall 32 defines a tube with a larger diameter than the inner tubular wall 34 of the discharge pipe 10 to define a gap 35 between the inner and outer tubular walls 34 and 32. Furthermore, the outer wall 32 is formed with a ring-shaped flexible (resilient) wall 36, while the flexible wall36 in turn is formed with or connected to a tubular attachment wall 37. The flexible wall 36 enables the downstream portion of the valve 4 to be moved in an axial upstream or axial downstream direction relative to the stationary base 3. At the free end of the tubular attachment wall 37 valve collar 13 is formed. The valve collar 13 is configured as a generally ring-shaped radially protruding portion of the tubular attachment wall 37 of the valve 4.

In the shown embodiment the receptacle 50 is a spout 51 comprising a tubular spout member 54 provided at the bottom end with a container attachment flange part 52 that can be attached (for instance welded) in any know manner to the walls of a flexible container, for instance a container formed by welding portions of flexible film material to each other. The tubular spout member 54 is also provided with a transversal flange 53 extending transversally of the axial direction of the spout, the flange being provided for more easy handling of the spouted container, for instance in a labelling machine and/or filling machine. The tubular spout member 54 further comprises a circumferential connection element 49. In the shown embodiment, the circumferential connection element 49 comprises a flange like protrusion that radially protrudes from the tubular spout member 54. Similarly, the base 3 may comprise a ring-shaped connection portion 56. The ring-shaped connection portion 56 may have a flexible lower edge that is configured to engage on the circumferential connection portion 49 of the tubular spout member 54. The ring-shaped connection portion 56 of the base 3 may have an inner diameter matching or slightly less than an outer diameter of the circumferential connection portion 49 of the tubular spout member 54 so as to firmly the base 3, to the drinking receptacle 50. More specifically, the base 3 may be slid over the discharge end of the receptacle 50 and the flexible connection portion 56 of the base 3 may be forcedly slid over the connection portion 49 of the receptacle 50 so that the connection portion 56 clicks over the flange like protrusion of the connection portion 49 of the tubular spout member 54 to thereby fix the sealing device 1 on the receptacle 50.

The outer surface of the tubular spout member 54 may (at an axial position between the connection portion 49 and the discharge end 55) comprise a plurality of external axial ribs/grooves 48. The external axial ribs/grooves are preferably evenly distributed over the circumference of the tubular spout member outer surface. The external axial ribs 48 are configured to engage corresponding ribs/grooves 47 provided inside the base 3 on the inner surface of a cylindrical flange 39 connected to or integrally formed with wall partition 31 (cf. FIG. 1) in order to prevent rotational motion of the base 3 with respect to the receptacle 50. This may reduce unintentional wear due to rotation of the base 3 relative to the receptacle 50 which may otherwise deteriorate the reliability of the connection of the sealing device 1 to the receptacle 50.

Figure 2A:
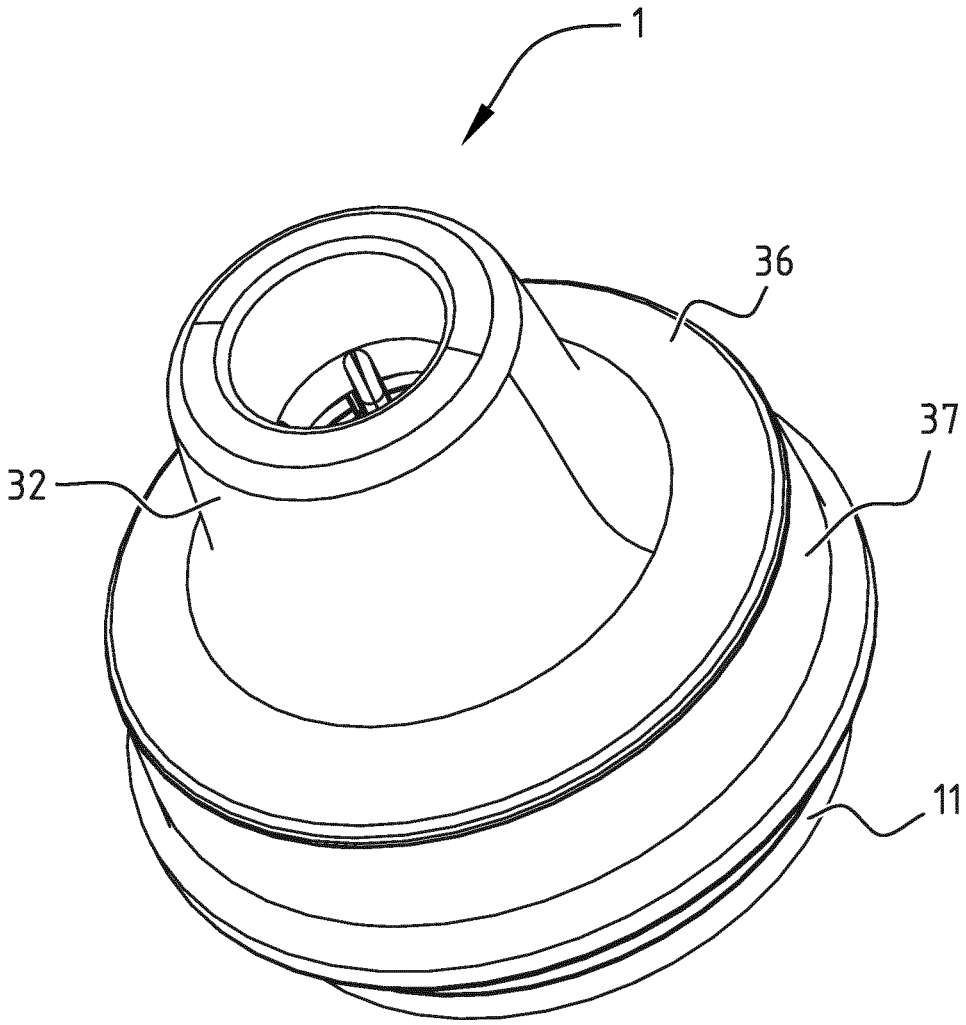
FIG. 2A shows a perspective side view of a second embodiment of the sealing device.
Figure 2B:
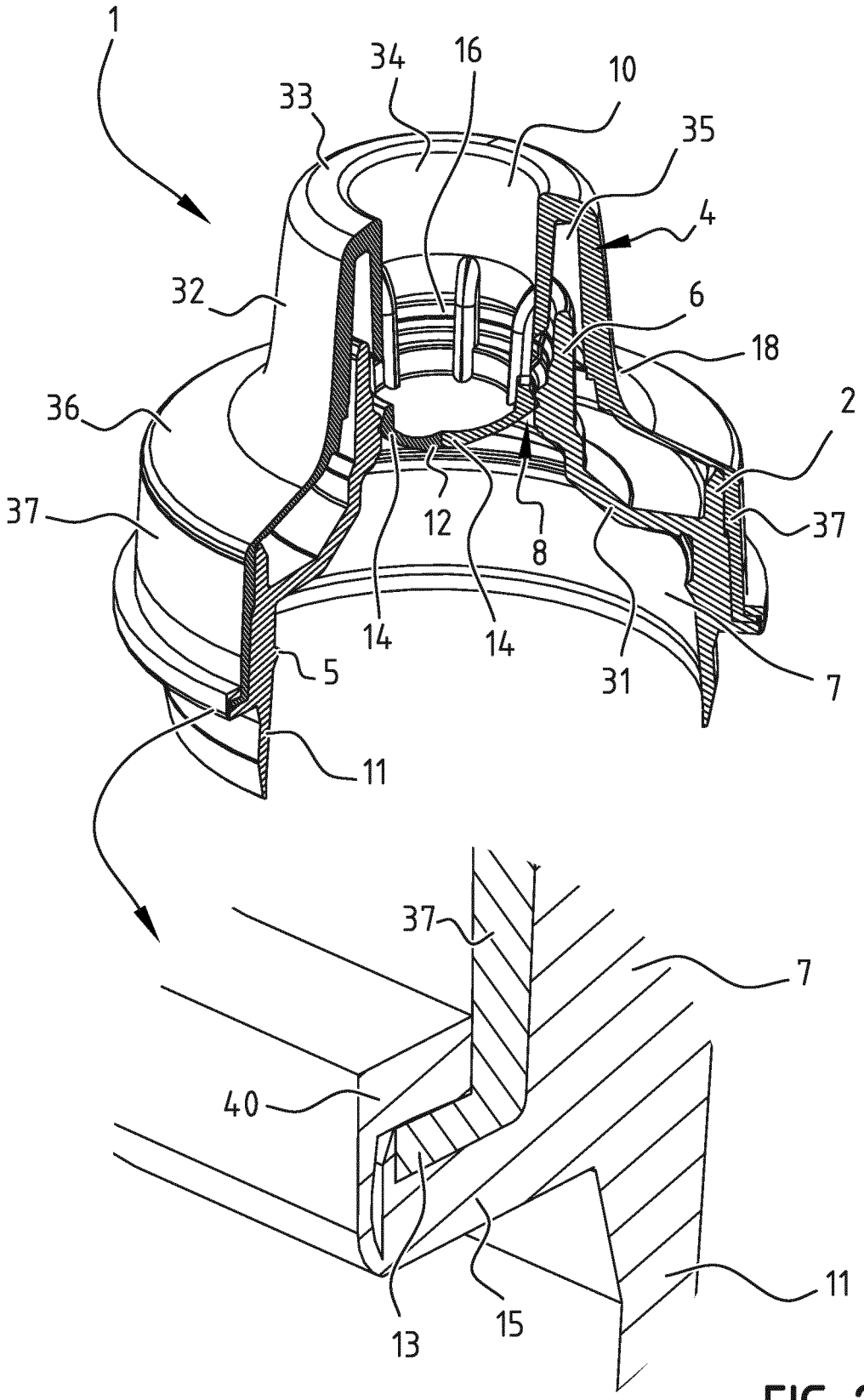
FIG. 2B and FIG. 2C show respective cut-away side views of the second embodiment of FIG. 2A.
Figure 2C:
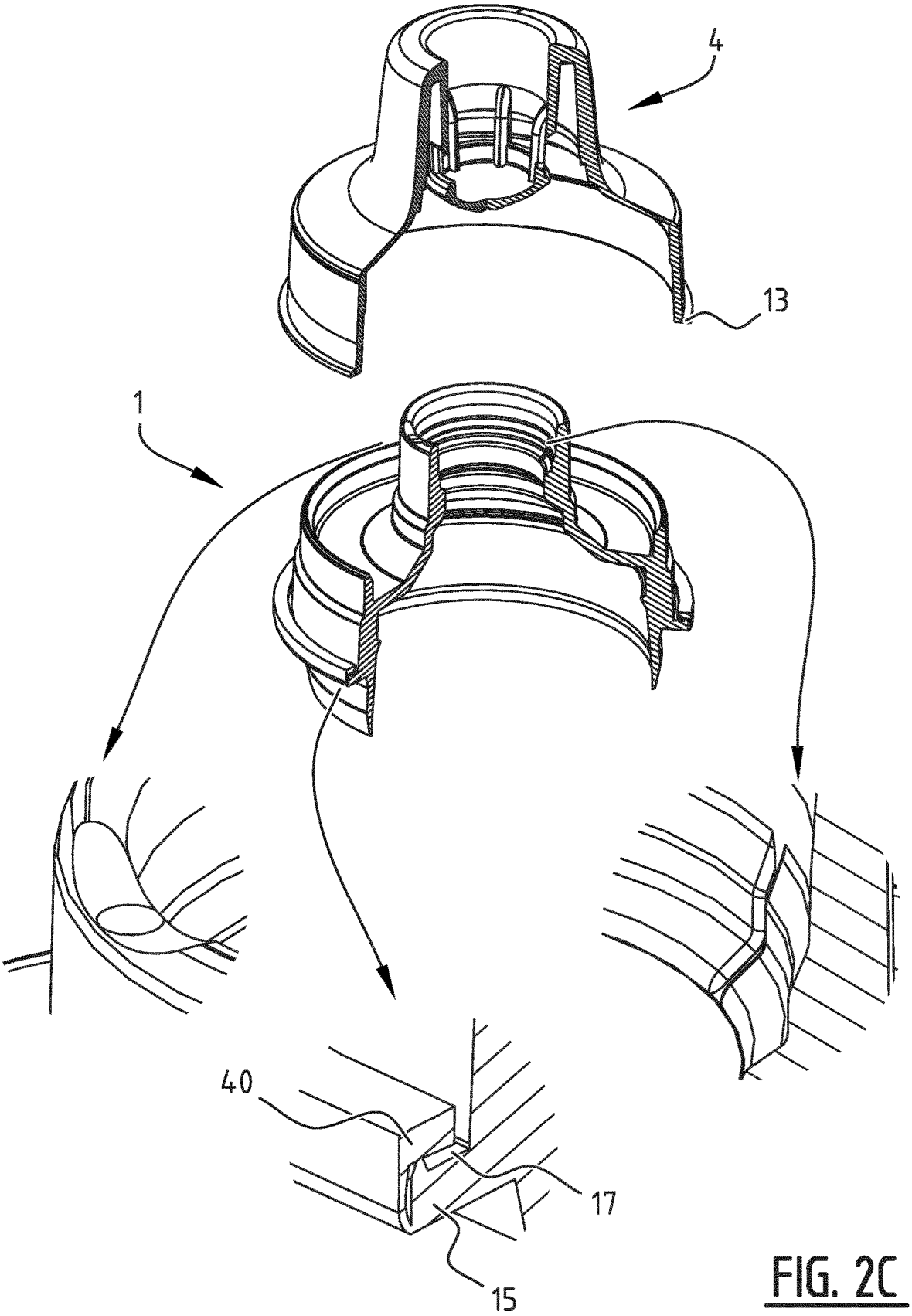
Figure 3A:
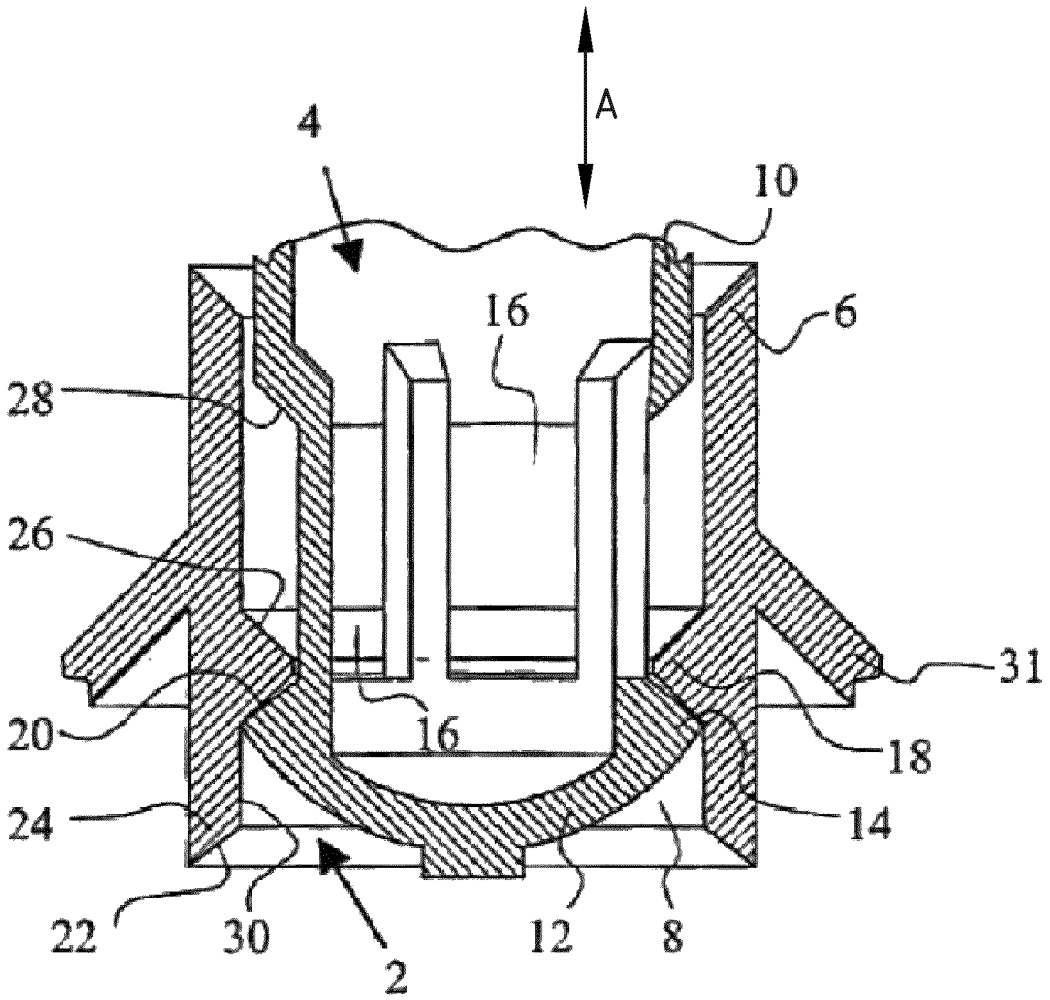
FIG. 3A, FIG. 3B, and FIG. 3C show longitudinal sections through an embodiment of a sealing device, in the storage mode, the open utility mode, and the closed utility mode, respectively.
Figure 3B:
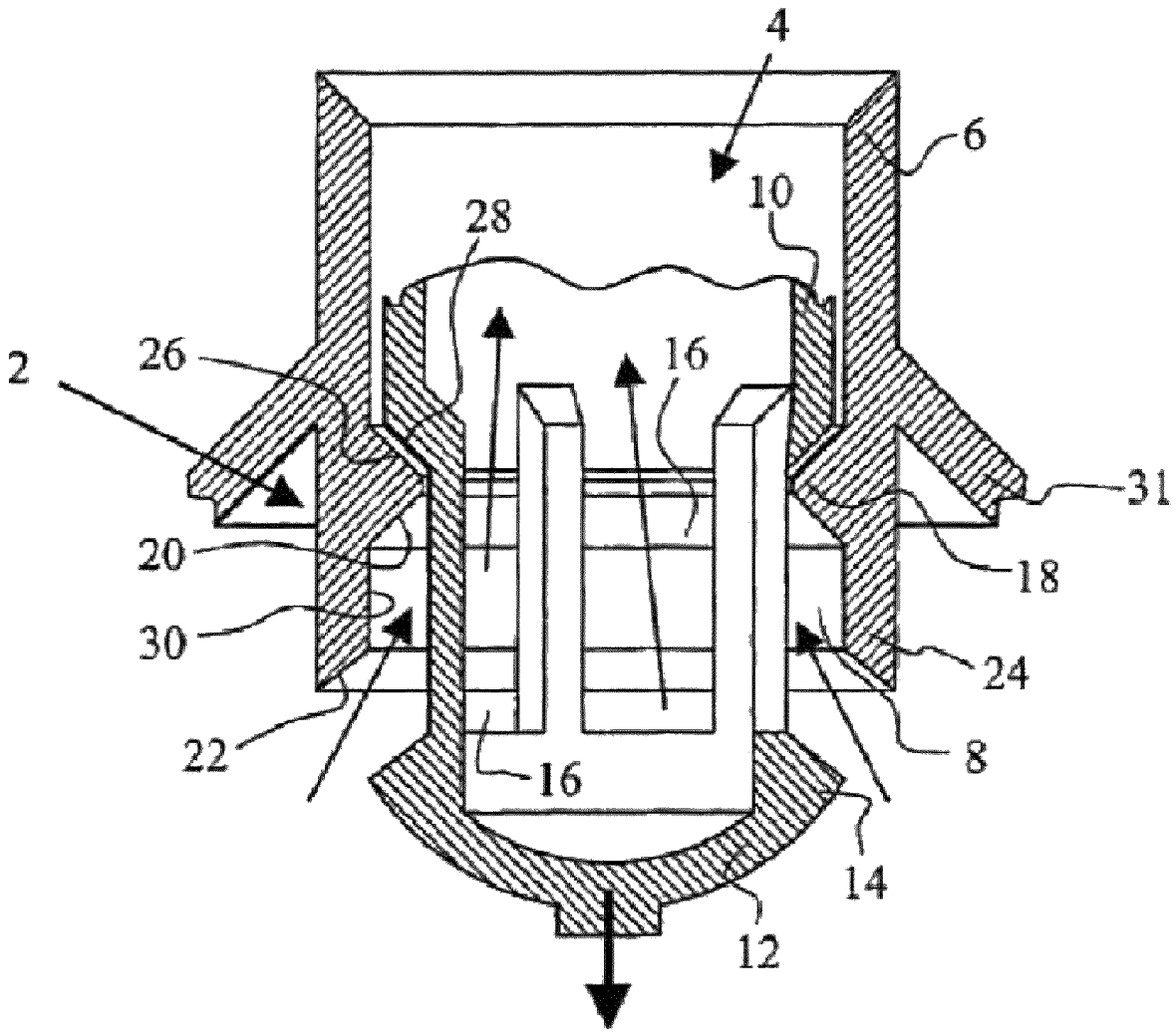
Figure 3C:
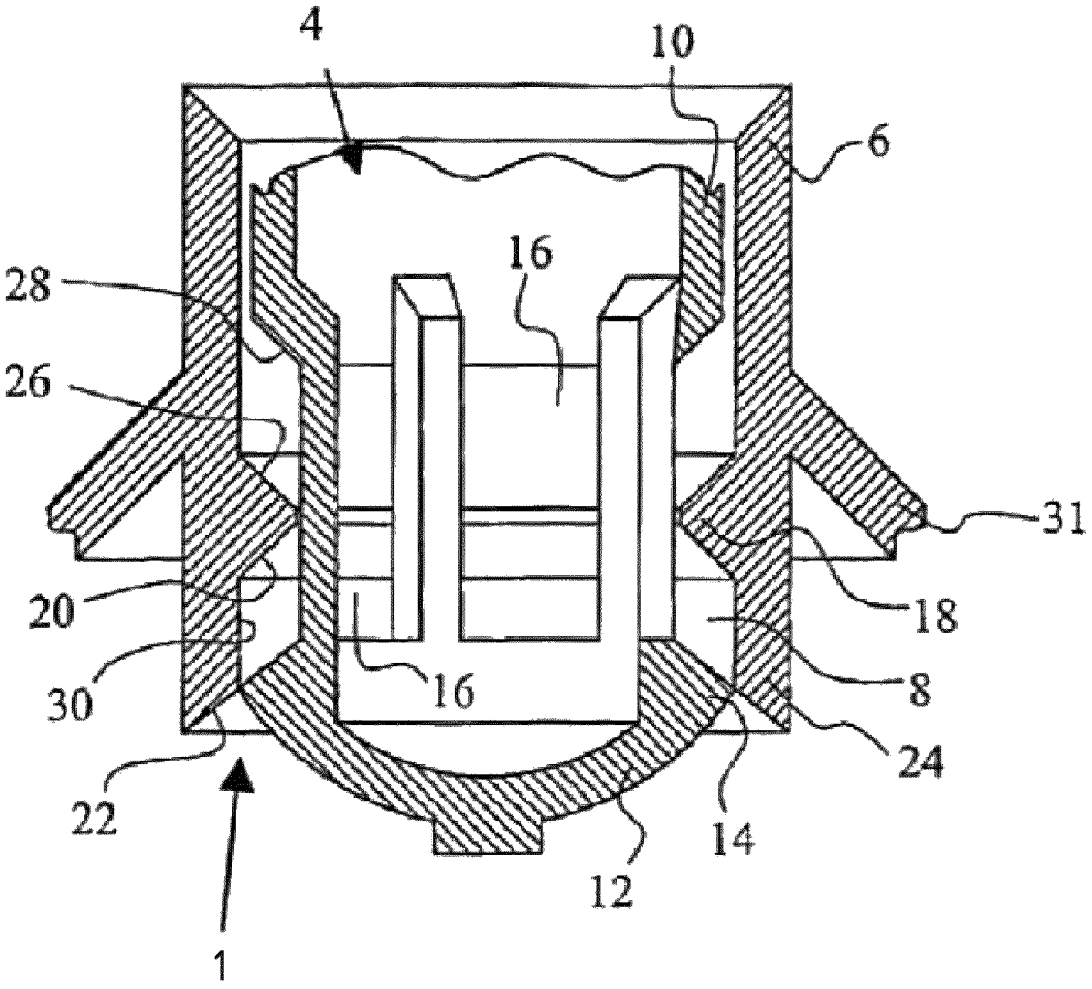

FIGS. 2A-2C and 3A-3B show a second embodiments of a sealing device 1 according to the present disclosure. FIGS. 2A-2C show various side views (FIGS. 2B and 2C being partially cut-away) of (details of) the second embodiment of the sealing device 1. The second embodiment corresponds with the first embodiment except for the absence of the ring-shaped connection portion 56 and the cylindrical flange 39. FIGS. 3A-3C are schematic cross-sections of a further embodiment and show a portion of a sealing device that is in common with the sealing devices of FIGS. 1 and 2A-2C.

While in the first embodiment depicted in FIG. 1 the receptacle 50 is shown to be a spout 51 forming part of a spouted container and the base 3 is attached to the spout 51 using the ring-shaped connection portion 56 arranged inside the base (more specifically inside the volume defined by the tubular base wall 7), the receptacle may also be part of or form another type of container, such as a bottle, for instance a glass or plastic bottle. Also in this case the base 3 of the sealing device may be attached to the receptacle by means of the ring-shaped connection portion. However, the base 3 can also be attached in a different manner to a receptacle. For instance, referring to the second embodiment depicted in FIGS. 2A-2C, a sealing device 1 can be mounted in a different manner on a drinking receptacle, for instance on the discharge end of a bottle. To this end, the sealing device 1 may comprise a tubular connection portion 11 (for instance, formed by a free cylindrical end of the earlier-mentioned tubular base wall 7 of base 3) having an outer diameter matching an inner diameter of a discharge end of the drinking receptacle, such that the sealing device 1 may be fitted in the discharge end of the receptacle. Alternatively, as will be discussed later, the tubular connection portion 11 may have an inner diameter matching an outer diameter of a discharge end of the drinking receptacle such that the sealing device 1 may be fitted over the discharge end of the drinking receptacle.

Figure 5:
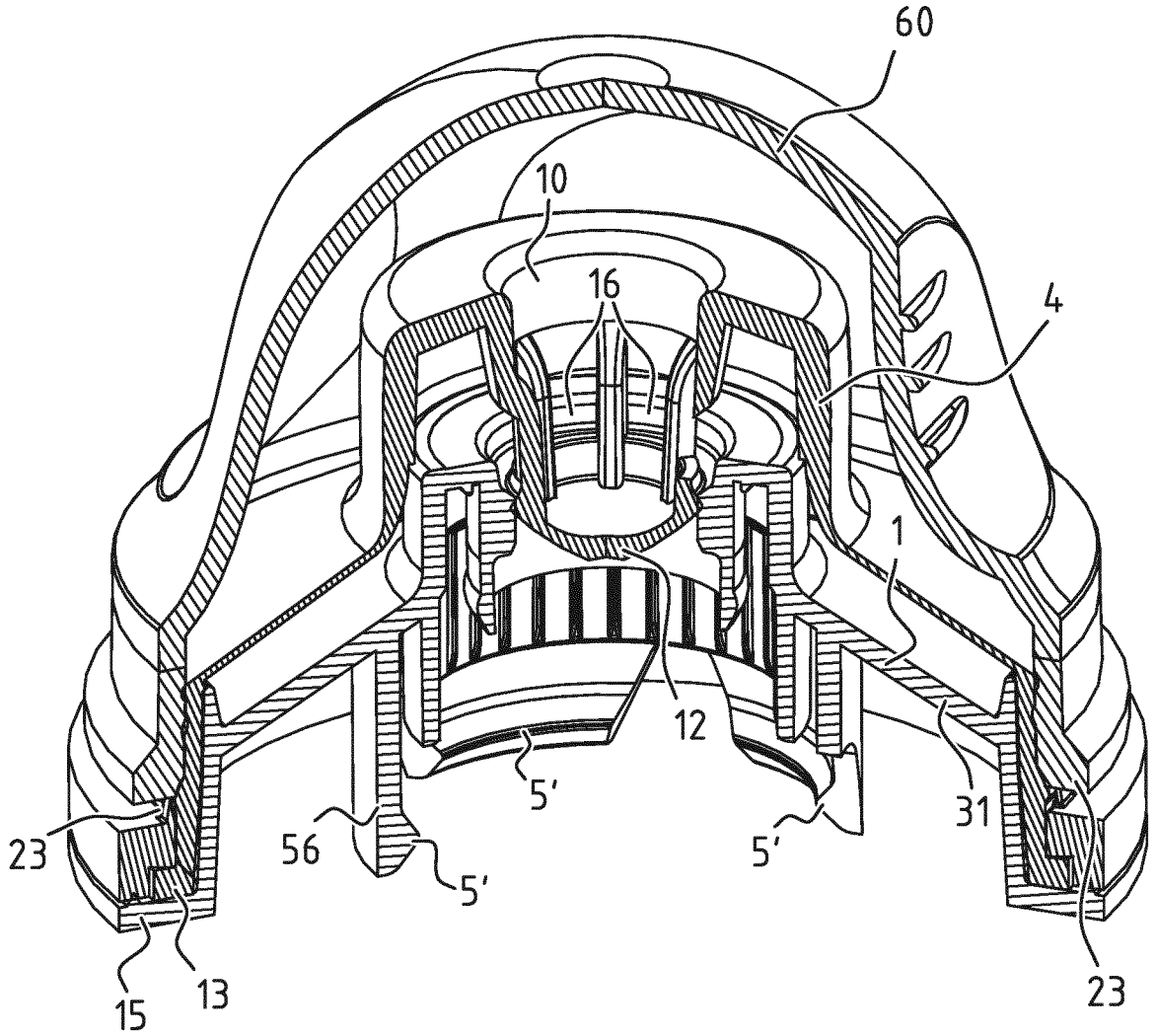
FIG. 5 shows a cut-away side view of a still further embodiment of the sealing device.

On top of the sealing device 1, an over cap 60 (herein also referred to as the covering lid, dust cap or end cap, cf. FIG. 5) may be placed to ensure the aseptic properties of the sealing device 1, for instance during transport and/or storage. Additionally, the over cap 60 may prevent unwanted opening of the valve, for instance in the transport phase of the sealing device from the sealing device manufacturer to the filling site where the container is filled.

Usually the sealing device is manufactured at a first geographical location, made ready for storage and then transported to a second, remote geographical location. Only when the sealing device has arrived at the second location the sealing device is attached to a receptacle of a container. At the same location or at further geographical location the container is then filled with content and made ready of use. The above-mentioned storage mode or position of the sealing device corresponds to the position of the valve 4 right after manufacturing thereof. The sealing device 1 is then ready for storage so as to be transported from the manufacturing site to the assembling and/or filling site wherein the sealing device is connected to a receptacle and wherein the associated containers is (optionally) filled. Once the container is filled, the valve may be kept in the storage position, ready for first opening by the end user.

Referring to FIGS. 2A-2C the valve 4 of the sealing device 1 according to the second embodiment comprises an axially movable discharge pipe 10 comprising an inner tubular wall 34. The inner tubular wall 34 of the discharge pipe 10 is seated inside the short, non-movable tubular body or sleeve 6 of the base 3, the sleeve 6 being part of the discharge conduit 8. The non-movable tubular body/sleeve 6 is herein also referred to as the stationary sleeve 6. FIG. 2B shows that the stationary sleeve 6 is connected to or integrally formed with a surrounding support structure in the form of the wall partition 31. As discussed earlier, the wall partition 31 may be connected to or integrally formed with the tubular connection portion 11 that is configured to allow the base 3 to be firmly connected to the receptacle 50.

As shown in FIGS. 3A-3C, the discharge pipe 10 is arranged coaxially in the sleeve 6 and is movable in axial direction (in the figures, upward and downward) relative to the stationary sleeve 6 between (at least) three different axial positions. The discharge pipe 10 is movable in axial direction and is configured for valve-activation. More specifically, the discharge pipe 10 constitutes a maneuver body in the form of a valve stem which may open or close the passage of liquid through the sealing device 1. The discharge pipe 10 comprises at its upstream end an upstream seal member 12. The upstream seal member may be formed by an end wall 12. This end wall of the discharge pipe 10 is closed, but in the side surface of the discharge pipe 10 one or more radial openings 16 are present allowing liquid to flow from the container, through the base passage and the valve passage to the outside, when the valve is in the open utility position of FIG. 3B.

As shown in FIG. 2B, the inner tubular wall 34 of the discharge pipe 10 is connected via a top wall 33 to an outer tubular wall 32. The outer tubular wall 32 defines a tube with a larger diameter than the inner tubular wall 34 of the discharge pipe 10 to define a gap 35 between the inner and outer tubular walls 34 and 32. Furthermore, the outer wall 32 is formed with a flexible (resilient) wall 36 (cf. FIGS. 1, 2A, 2B), extending obliquely or transversally relative to the axial direction), while the flexible wall36 in turn is formed with or connected to a tubular attachment wall 37. The tubular attachment wall 37 of the valve 4 can be mounted firmly to the stationary base 3, as will be explained later. The flexible wall 36 enables to outer tubular wall 32 (and therefore also the discharge pipe 10) to be movable upward or downward between the storage position, open utility position and closed utility position) relative to the non-movable (stationary) tubular attachment wall 37 of the valve 4 (and of course also relative to the non-movable (stationary) base 3 to which the valve 4 is connected).

For opening and closing of the discharge passage, the valve 4 comprises a sealing body 9, preferably a sealing body formed by an elastic ring-shaped seal collar 14 extending outwardly towards the sleeve 6. The sealing body 9 is located at the upstream seal member (upstream end wall 12) of the discharge pipe 10. The seal collar 14 may be formed from a suitable plastics material, which is elastic by nature. As mentioned above, the discharge pipe 10 is also provided with several pipe wall radial openings 16. These radial opening 16 are located immediately downstream of the seal collar 14. Thereby, discharge of a liquid will take place through the pipe wall openings 16 and the discharge pipe 10 when the valve is in the open utility mode. Along its inner periphery, the sleeve 6 is provided with a ring-shaped seal bulb 18 (cf. FIG. 2B, and, in more detail, FIGS. 3A-3C) extending into the sleeve 6. The seal bulb 18 includes an upstream-directed storage seal seat 20 structured for sealing reception of said seal collar 14 when the valve 4 is in the storage mode, such as shown in FIG. 3A. This is possible because the seal collar 14 is located in a region upstream of the seal bulb 18.

Furthermore, the sleeve 6 is provided with an upstream-directed, ring-shaped end seat 22 also located upstream of the seal bulb 18 and being one of several utility seal seats in the sleeve 6. In this exemplifying embodiment, the end seat 22 is comprised of an upstream-directed bevel edge formed at an upstream end 24 of the sleeve 6. The end seat 22 is structured for sealing reception of the seal collar 14 when the valve 4 is in the closed utility mode, such as shown in FIG. 3C. Thus, the valve 4 is structured for opening of the discharge conduit 8 by virtue of upstream-directed movement of the seal collar 14 relative to the discharge direction of the valve, and away from the end seat 22, in which position the valve 4 is in the open utility mode, such as shown in FIG. 3B. In FIG. 3B, the discharge direction is indicated with downstream-directed arrows, whereas the movement direction of the seal collar 14 during valve opening is indicated with an upstream-directed arrow.

The seal bulb 18 also includes a downstream-directed, ring-shaped stop seat 26. This stop seat 26 is structured for motion-limiting contact with an external stop collar 28 formed around the discharge pipe 10 in a region located downstream of said pipe wall openings 16 and downstream of the seal bulb 18. FIG. 3B shows the stop collar 28 in contact with the stop seat 26 subsequent to upstream-directed and valve opening axial movement of the discharge pipe 10.

The sleeve 6 also includes an internal and cylindrically shaped seal portion 30 located in a longitudinal portion between said end seat 22 and the seal bulb 18. In this example of an embodiment, the entire seal portion 30 is structured for slide-sealing against the seal collar 14. When in its radially expanded position, this seal collar 14 is arranged to have a marginally larger diameter than the diameter of the internal, cylindrical seal portion 30, such as shown in FIG. 3C. The cylindrical seal portion 30 may thus function both as continuous storage seal seats and utility seal seats, and the seal collar 14 will be somewhat compressed radially when positioned in the seal portion 30. Thus, all of the storage seal seats 20, 30 and utility seal seats 22, 30 are structured for sealing against the seal collar 14 during downstream-directed movement thereof.

The upper part of FIG. 2B illustrates a partly cut-away side view of the sealing device 1 of FIG. 2A, while the lower part of FIG. 2B illustrates a detailed cross-section of the bottom end of the base 3 of the sealing device 1. The base 3 supports the valve 4 and is configured to allow the valve 4 to be positioned in the open utility mode, the closed utility mode and/or the storage mode. To this end, the base 1 comprises a tubular connection portion 11 configured to be mounted to the receptacle 50. The tubular connection portion 11 is connected to or integrally formed with a tubular base wall 7 that is connected to or integrally formed with wall partition 31. Also an upper portion of the wall partition 31 takes a tubular shape and constitutes the sleeve 6 relative to which the discharge pipe 10 may be displaced. The partition wall 31 also is provided with an annular axial rim 2 creating a gap between the outer side of the partition wall 31 of the base 3 and the inner side of the outer tubular wall 32 and flexible (resilient) wall 36 so as to provide sufficient space for the discharge pipe 10 to be moved in axial direction. If an axial force is exerted on the valve 4 in the direction of the upstream end wall 12, for instance by a user pushing his lips onto the valve, the discharge pipe 10 of the valve 4 is moved from the storage mode or closed utility mode to the closed utility mode and/or the open utility mode. Due to resilient properties of wall part 36 of the valve 4 facing the partition 31, the sleeve 6 of the valve 4, after said exertion of force is relieved, may be moved relative to the base 3 from the open utility mode to the closed utility mode.

For example, in FIGS. 2B and 3B, the sealing device 1 is illustrated in the storage mode, said exertion of force may force the upstream end wall 12 in the upstream direction to be moved into the closed utility mode (cf. FIG. 3C), further application of force in said direction may force the upstream end wall 12 to move further in said direction, thereby forcing the sealing device 1 in the open utility mode (cf. FIG. 3C), thereby allowing fluidic flow from a drinking receptacle arranged upstream of the sealing device 1.

In principle, the valve 4 of the first or second embodiment could be placed on the base 3 in a non-fixed manner. For example, the valve 4 and base 3 could be jointly mounted in a cap, a cap-like cover or the like wherein the cap comprises a radially narrowed portion that acts as a seat for the valve collar 13 and/or the base collar 15 to mount the base 3 and the valve 4 in a cap, a cap-like cover or the like in a click-like manner. However, such a manner of mounting may be unreliable, wherein the base 3 and the valve 4 may come loose or lose their sealing properties. Therefore there is a need for fixedly connecting the valve 4 and the base 3 at least in a portion of and/or near the valve collar 13 and the base collar 15.

To achieve a more reliable seal of the sealing device 1 as a whole, it is considered in the present disclosure to fix the valve 4 and the base 3 to each other. The fixed connection may be achieved according to embodiments of the present disclosure by placing a ring-shaped attachment element over both collars 13, 15 and attaching the same to both the base collar 15 of the base 3 and the valve collar 13 of the valve 4. In other embodiments the ring-shaped attachment element may be an integral part of either the base collar 15 or the valve collar 13. In these embodiments the ring-shaped attachment element only needs to be attached to the other collar 13,15.

Referring to FIGS. 1 and 2A-2C, the valve 4 and the base 3 may be connected to each other using a clamping ring 40. The base wall 7 comprises a radially protruding circumferential base collar 15 of the base 3, while the tubular attachment wall 37 of the valve 4 comprises a similar radially extending circumferential valve collar 13. After having placed the valve collar 13 is positioned on the base collar 15, the clamping ring 40 can be placed around the base so to contact both the valve collar 13 and base collar 15. The clamping ring 40 may be connected to both the valve collar 13 and the base collar 15 by any attachment technique, such as gluing and/or welding (for instance heat welding, ultrasonic welding, RF welding, pressure welding and/or impact welding or snap). Preferably, the clamping ring 40 is fixedly connected to the valve collar and/or base collar 15 by ultrasonic welding. The clamping ring 40 preferably comprises at least a portion covering a radially extending portion of the valve collar 13 of the valve 4 and at least a portion fixedly connected to the valve collar 15. Thereby movement of the valve collar 13 with respect to the base collar 15 (both axial movement and rotational movement) is prevented.

The clamping ring may be a separate ring that is arranged around the collars 13,15 once they have been placed on top of each other. In other embodiments, the clamping ring 40 is an integrally formed part of either the base collar 15 or the valve collar 13. In the embodiment of FIGS. 2B and 2C the clamping 40 is integrally formed with the base collar 15. The clamping ring 40 only needs to be attached (glued and/or welded) to the other collar, again by gluing and/or welding.

Referring again to the embodiment shown in FIGS. 2B and 2C, the valve 4 and the base 3 are separate elements prior to joining thereof. The clamping ring 40 is integrally formed with the base collar 15 whereby a base collar gap 17 (cf. FIG. 2C) is formed in between a portion of the clamping ring 40 and a portion of the base collar 15, the shape of said gap 17 being such that it substantially corresponds to the shape of the portion of the valve collar 13 to be fitted in the gap 17 and such that, when the valve collar 13 is fitted in said gap 17, axial movement of the valve collar 13 with respect to the base collar 15 is prevented. To this end, when the valve collar 13 is applied in the gap 17, the clamping ring 40 may be configured to have a portion of the clamping ring 40 snap over the valve collar 13, thereby preventing axial movement of the collar 13 with respect to the base collar 15. In addition, the clamping ring 40 may be further fixed to the base collar 15 and/or the valve collar 13. As mentioned before, fixing the clamping ring 40 to the valve collar 13 may be performed by gluing, heat sealing, ultrasonic sealing, RF sealing, pressure sealing and/or impact sealing. Preferably, the clamping ring 40 is fixedly connected to the valve collar 13 by ultrasonic sealing.

Returning to FIG. 2B, alternatively or additionally, the base 3 may at the inner circumference of the base wall 7, more specifically at the inner circumference of the tubular connection portion 11 of the base 3, be attached to a spout seat 5 (corresponding to spout seat 51 in FIG. 1). The spout seat 5 locally decreases the inner diameter of the tubular connection portion 11. The tubular connection portion 11 may be configured to be placed over a receptacle formed by a spout wherein the spout has an outer shape corresponding to the inner shape of the tubular connection portion 11. For example, the inner diameter of the tubular connection portion 11 may correspond to an outer diameter of the spout at which connection portion is to be mounted. The spout may for instance have a substantially cylindrical connection portion (not shown in the figures). Such connection portion preferably comprises a radially protruding portion forming a flange-like protrusion wherein said spout seat 5 is configured to cooperate with said flange to attach the sealing device 1 onto the spout. For instance when the sealing device 1 is mounted on the spout, the spout seat 5 may be snapped over the flange to prevent the sealing device 1 from moving with respect to the spout.

Alternatively or additionally, the tubular connection portion 11 may comprise an inner threading configured to be screwed onto an outer threading of a drinking receptacle. Further alternatively or additionally, as mentioned above, the outer surface of the tubular connection portion 11 may be configured to be fitted in the inner circumference of a connection portion of a receptacle.

Figure 4A:
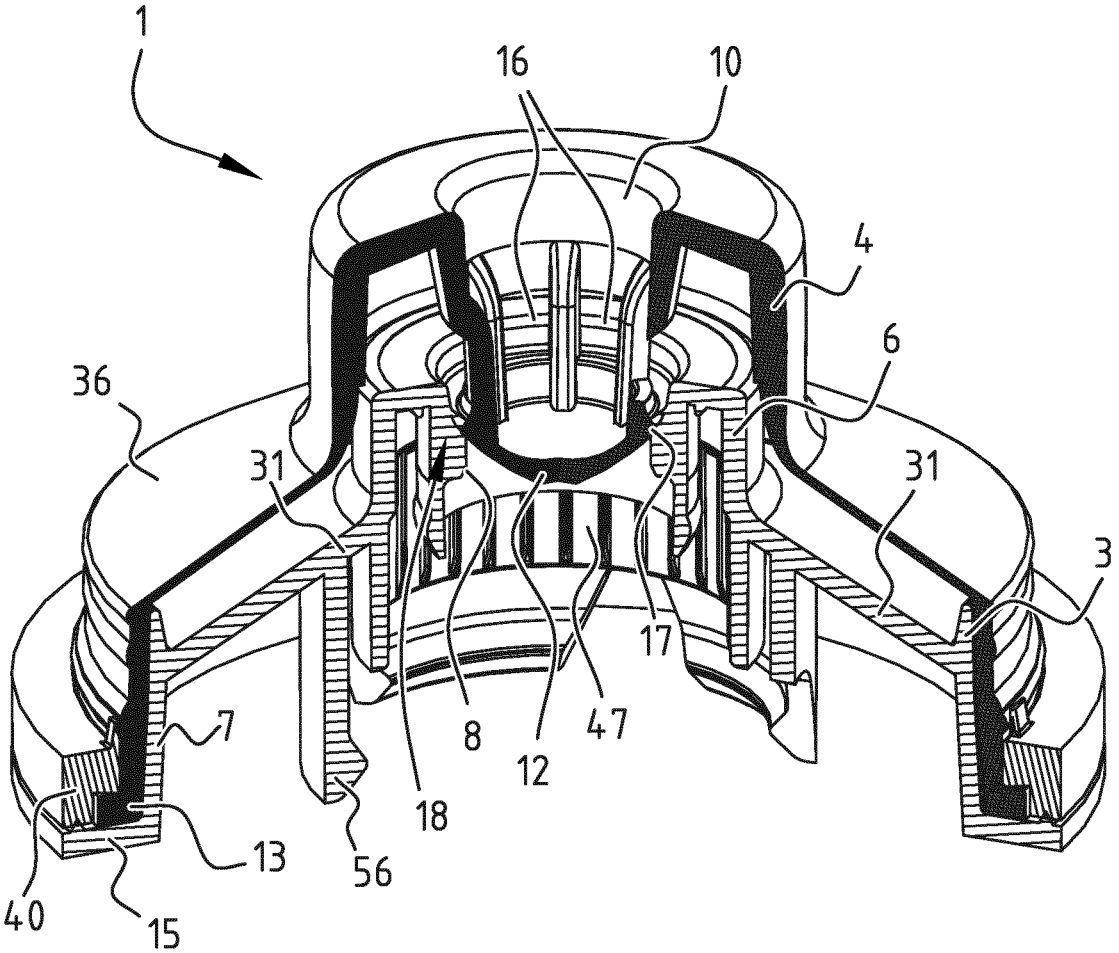
FIG. 4A and FIG. 4B show a cut-away side view and an exploded view of a further embodiment of the sealing device, respectively.
Figure 4B:
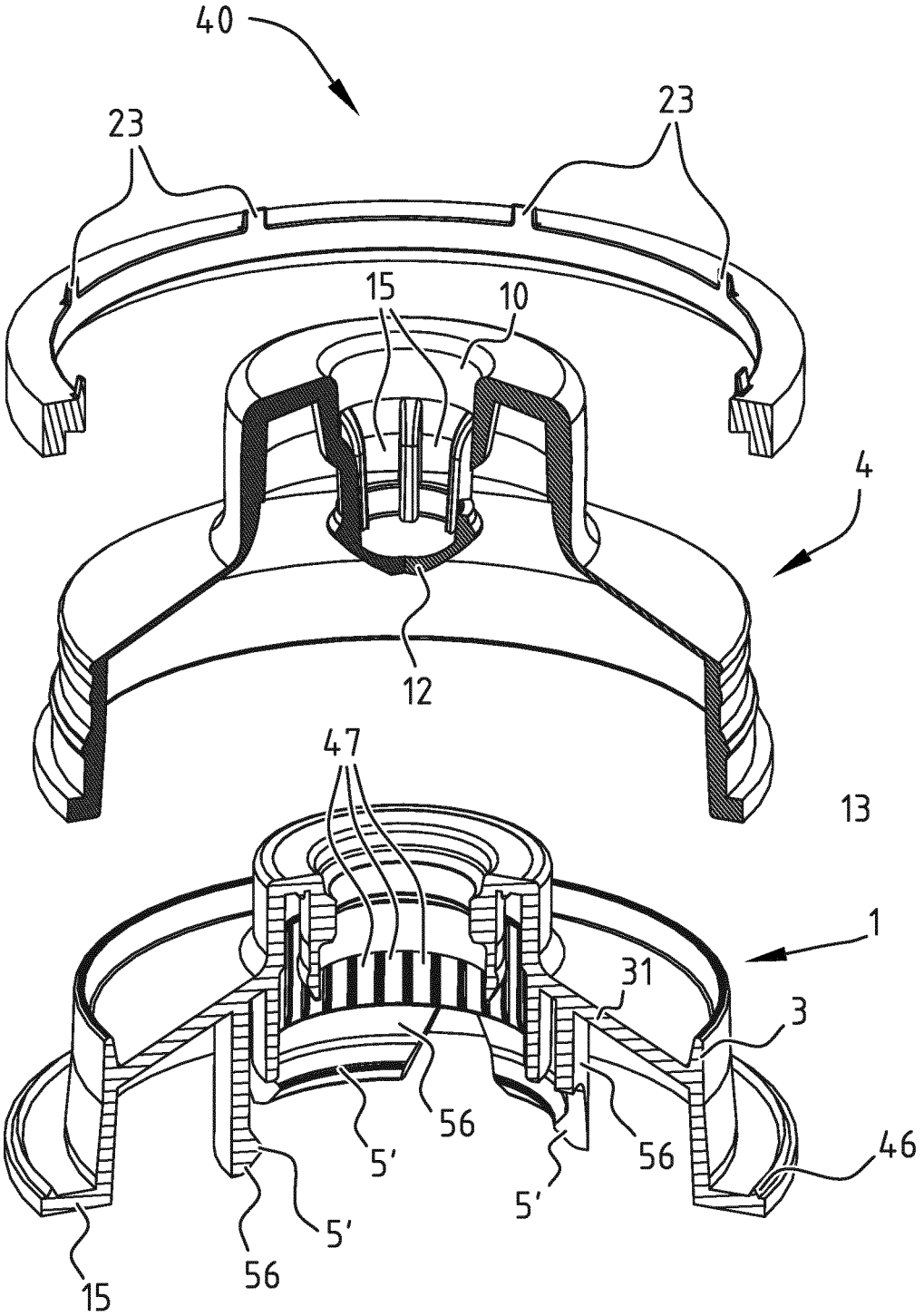

FIGS. 4A-4B show partly cut-away perspective views of another embodiment of the sealing device. Like elements have been provided with like reference numbers and a separate detailed description thereof has been omitted. The difference between the embodiment of FIGS. 4A and 4B and the embodiment of FIGS. 1, 2A-2C mainly resides in the features relating to the tubular base wall 7 and/or connection portion 11 (cf. FIGS. 2A-2C) and connection portion 56 (cf. FIGS. 4A-4B, similar to the connection portion shown in FIG. 1), 11' and the corresponding spout seat 5'. Similar to the embodiment of FIG. 1, the embodiment of FIGS. 4A-4B has a connection portion 56 for snap-fitting on a connection portion 49 on the tubular spout member 54 of a spout type receptacle 50.

Further, the embodiment of FIGS. 4A-4B comprises one or more base anti-rotation ribs and/or grooves 47, also discussed in connection with FIG. 1. The ribs/grooves 47 may also be applied in each of the other embodiments described herein.

The connection portion 56 of FIGS. 4A-4B is configured to receive a connection portion of a spout therein. The connection portion 56 has a reduced inner diameter with respect to the tubular base wall 7. To this end, the connection portion 56 is connected to the base 3 by an axial tubular flange starting from the bottom surface of the partition wall 31 and extending downward. The outer end of this axial tubular flange is formed by the connection portion 56. The connection portion 56 is configured to have an inner diameter matching an outer diameter of a connection portion of a receptacle, for instance—but not limited to—the receptacle of FIG. 1, at which the sealing device 1 is to be mounted. The upstream portion of the connection portion 56 may comprise a spout seat 5' with similar purpose as the spout seat 5 shown in FIG. 1. The spout seat 5' may be discontinuous along the upstream portion of the connection portion 56 in order to allow the connection portion 56 to temporarily deform in order to accommodate a snapping locking action of the spout seat 5' over the flange-like protrusion 49 of the receptacle 50.

In FIG. 4B another construction for mounting the valve 4 to the base 3 is illustrated. The base 3 may comprise a radially protruding base collar 15 that has an increased outer diameter with respect to the outer diameter of the valve collar 13. The base collar 15 may comprise one or more welding ridges 46, i.e. a locally increased thickness of the base collar 15, wherein the welding ridges 46 are configured to assist the welding operation. In the exemplary embodiment of FIG. 4B, one continuous welding ridge 46 is illustrated; however the person skilled in the art will recognize that a plurality of welding lines may also be applied. The welding line 46 may be a continuous or a discontinuous welding line and may be positioned on a portion of the base collar 15 that is extending further in the radial direction than the radially outermost portion of the valve collar 13. The clamping ring 40, illustrated as a separate element, may be provided on the valve 4 and the base 3. The clamping ring 40 will be in contact with the base 3 via the base collar 15 at the position of the welding line 46. The clamping ring 40 is connected to the base collar 15 via gluing, heat welding, ultrasonic welding, RF welding, pressure welding and/or impact welding, preferably ultrasonic welding. The clamping ring 40 comprises a portion that is covering at least a portion of the valve collar 13 in the axial direction of the sealing device 1. Thereby axial and rotational movement of the valve collar 13 with respect to the base collar 15 is prevented.

In FIG. 4B a plurality of optional cap connectors 23 are illustrated on the clamping ring 40. The cap connectors 23 may be integrally formed with the clamping ring 40 or may be separate elements configured to allow connection of a cap to the valve 4 and/or base. Alternatively or additionally the cap connectors 23 are integrally formed with both the cap and the clamping ring 40 so that they form one interconnected unit. For instance, the cap connectors 23 can be configured to connect with the dust cap 60 as illustrated in FIG. 5. This figure is a perspective view of the sealing device 1 of FIGS. 4A and 4B. In FIG. 5 the sealing device 1 is provided with a cap 60 that may prevent dust, solids, fluids, bacteria or other unwanted substances from coming into contact with the valve 4 of the sealing device 1. Additionally, the cap 60 may, for example, prevent the valve 4 of the sealing device 1 to be unintentionally pushed into the open utility mode or, when the sealing device 1 is in the storage mode, prevent that the sealing device 1 is unintentionally pushed into the closed utility mode. The cap 60 may be mounted on the clamping ring 40 in a removable manner, for instance via the cap connectors 23. To this end the cap connectors 23 may be connected to the cap 60 in a manner that a pull action on the cap 60 may break the connections of the cap connectors 23 to the cap 60. Alternatively or additionally, the dust cap may be mounted in a flippable manner on the clamping ring 40 or the dust cap comprise two dust cap parts: a first part permanently or removably connected to the clamping ring, and a second part hingedly connected to the first cap part allowing the second part to be moved between a closed and open position.

Figure 6A:
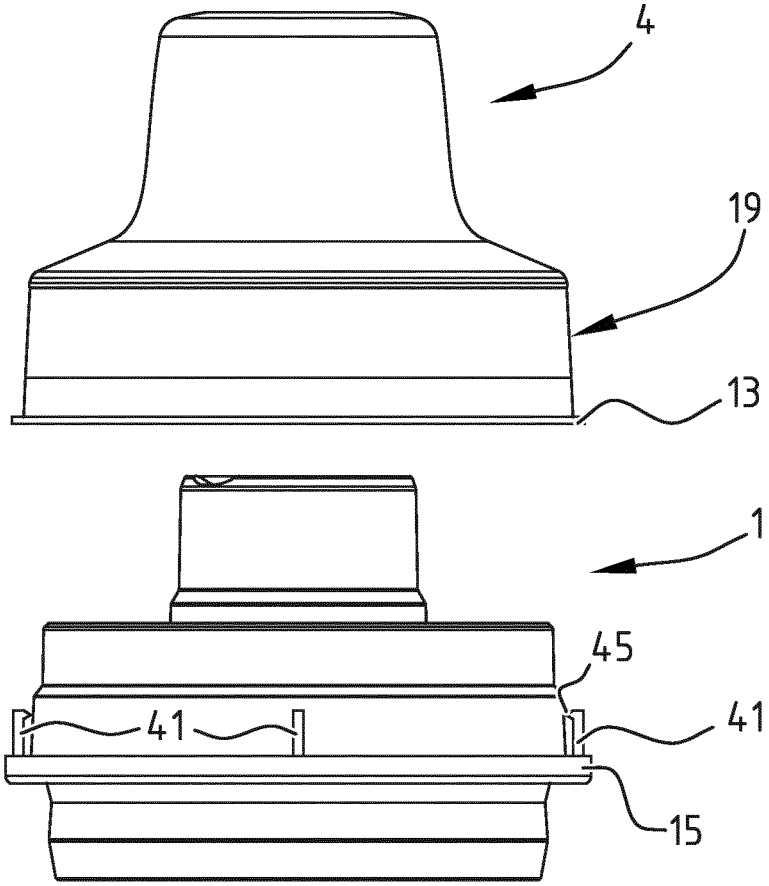
FIG. 6A, FIG. 6B, and FIG. 6C illustrate further embodiments of the sealing device and different manners of attaching a valve.
Figure 6B:
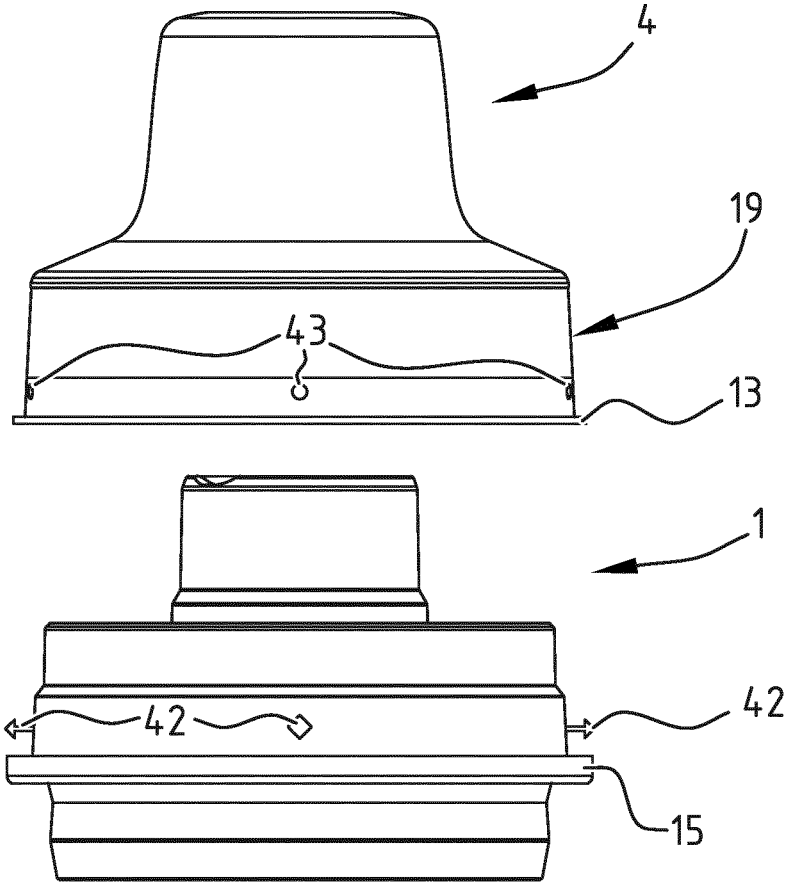
Figure 6C:
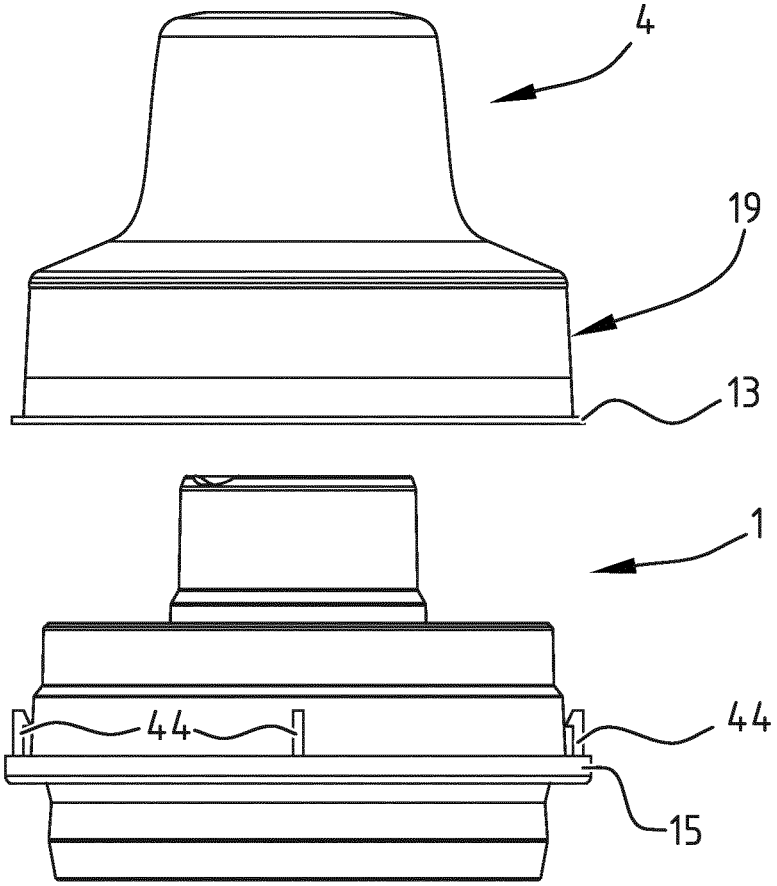

FIGS. 6A-6C illustrate further embodiments of the sealing device, wherein different manners of attaching a valve to a base are elucidated.

In FIG. 6A, a plurality of welding elements 41 are illustrated. The welding elements 41 are integrally formed with the base 3 prior to connection thereof to the valve 4. During connection of the base 3 and the valve 4, the welding elements 41 may be connected to an upstream side of the valve 19, these welding elements 41 may be connected to the upstream side of the valve 19 by gluing, heat welding, ultrasonic welding, RF welding, pressure welding and/or impact welding, preferably ultrasonic welding. Due to such connections movement of the valve collar 13 with respect to the base collar 15 is prevented.

In addition, in some embodiments, the upstream side of the valve 19 may comprise a plurality of holes (not shown) at positions corresponding to the position of the welding elements 41 to allow at least a welding tip 45 of the welding element 41 to protrude through said hole such that a welding element 41 may also be connected to the base 3 at a portion thereof facing said welding tip 45.

The person skilled in the art will recognize that the welding elements 41 may alternatively be positioned on the valve 4, for example, the welding elements may be arranged in the upstream side of the valve 19 in replacement of the valve collar.

In FIG. 6B, a plurality of connection elements 42 are illustrated. The connection elements 42 are integrally formed with the base 3 prior to connection thereof to the valve 4. During connection of the base 3 and the valve 4, the connection elements 42 may be connected to an upstream side of the valve 19, these connection elements 42 may be connected to the upstream side of the valve 19 by forcing an arrow shape-like end of an connection element 42 through a corresponding connection hole 43 in the upstream side of the valve 19. Preferably, the arrow shape-like head of the connection element 42 has a similar but slight preferably larger maximum diameter than the diameter of the hole such that, after the connection element 42 is forced through the connection hole 43 reversal thereof is difficult to achieve. Due to such connections movement of the valve collar 13 with respect to the base collar 15 is prevented. In addition, in some embodiments, the connection elements 42 may be welded to the valve 4.

The person skilled in the art will recognize that the connection elements 42 may alternatively be positioned on the base collar 15 facing the valve collar 13 and/or the valve 4, for example, on the valve collar 13 facing the base collar 15. In such embodiments the connection holes would be positioned at corresponding positions in the valve collar 13 and/or base collar 15.

In FIG. 6C, a plurality of clamping elements 44 are illustrated. The clamping elements 44 are integrally formed with the base 3 prior to connection thereof to the valve 4. During connection of the base 3 and the valve 4, the clamping elements 44 may be connected to an upstream side of the valve 19, these clamping elements 44 may be connected to the upstream side of the valve 19 by forcing the valve collar 13 past an inwardly pointed protrusion of the clamping elements 44. As a consequence thereof, the valve collar 13 is clamped to the base 3 via the clamping elements 44. Thereby movement of the valve collar 13 with respect to the base collar 15 is prevented. In addition, in some embodiments, the clamping elements 44 may be welded to the valve 4. The person skilled in the art will recognize that clamping elements 44 may alternatively be positioned on the valve collar 13 facing the base collar 15.

Preferably, the sealing device and the valve are structured for releasable connection to the drinking receptacle, for example via a suitable enclosure. Opening and closing of the valve may be carried out manually, but valve activating auxiliary mechanisms known per se may also be used for this purpose.

Figure 7A:
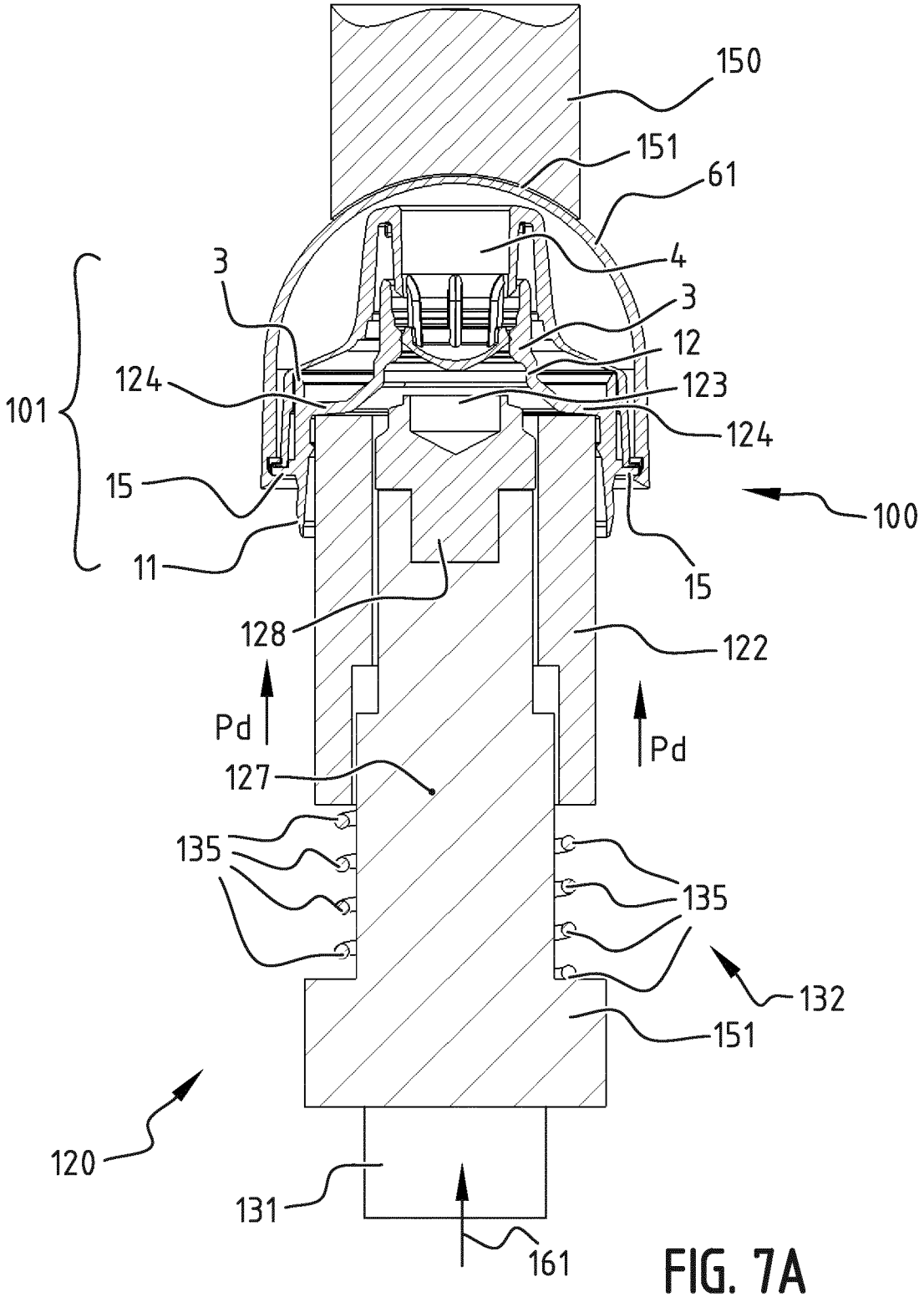
FIG. 7A and FIG. 7B are longitudinal sectional views of an embodiment of a handling device, respectively in a first and second position.
Figure 7B:
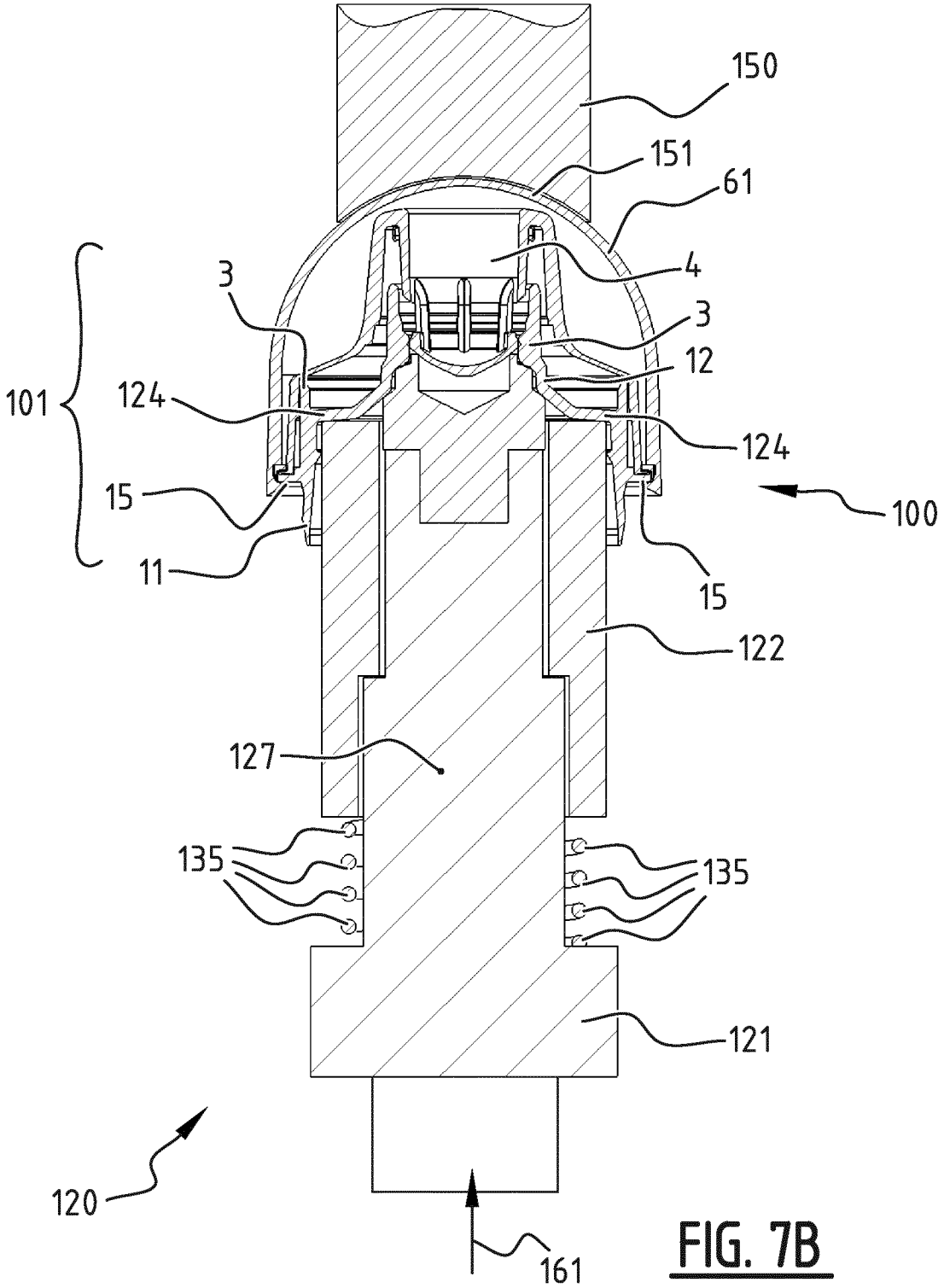

FIGS. 7A and 7B illustrate an embodiment of a handling device 100 according to the present disclosure. In the figures the handling device 100 is shown handling the sealing device according to the embodiments of FIGS. 2A|-2C. A similar handling device may be used of course to handle any of the other embodiments described herein.

The handling device100 is configured for positioning the upstream seal member 12 of a sealing device 1 in a closed storage position (i.e. the storage position). The sealing device 1 comprising a base 3 and the valve 4 may be pre-produced at a first location (for instance a factory) and connected to each other forming a sealing unit, for instance as explained earlier. The sealing unit may then be stored and/or transported to a second location (for instance an assembly site) wherein a protective cap 61 is connected to the sealing unit. At the same time the protective cap 61 is connected to the sealing unit, the valve 4 may be forced to be positioned in the storage position. Then the sealing device (comprising the sealing unit and the protective cap connected thereto) is connected to a receptacle 50. At the same location (or a further location, remote from the second location) the receptacle 50 may have been of may be filled with content.

In the exemplary situation wherein the base and valve have been premanufactured and already have been connected to each other at a first location (remote from a second location wherein the sealing device is attached to a receptacle and/or the receptacle is filled with content), there is a risk that during transportation of the sealing device from the first to the second location, the base 3 and the valve 4 may become slightly displaced relative to each other or even become detached from each other. This may be the result of the sealing device 1 having undergone significant shaking or the like during transportation or the result of the base 3 and the valve 4 not having been properly joined to each other, for instance when the clamping ring 40 has not been used or not been used properly. The fact that this situation may occur means that after transportation of de sealing device, at the stage wherein the sealing device is attached to the receptacle and/or the receptacle is filled with content (for instance a liquid), it is not fully certain whether the (discharge pipe of the) valve is in the proper position or mode (e.g. the storage position) for the receptacle to be filled and the filled receptacle to be handled further. Therefore it should be ascertained that the discharge pipe of the valve is brought into the right position.

Also in the exemplary situation wherein the base 3 and the valve 4 forming part of the sealing device 1 have been produced at different locations and the sealing device is only assembled shortly prior to attaching the sealing device 1 on the receptacle and/or filling the receptacle with content, it is not certain whether the (discharge pipe of the) valve is in the proper position or mode (e.g. the storage position) for the receptacle to be filled and the filled receptacle to be handled further. The same applies to exemplary situations wherein the base 3 and the valve 4 may be have been integrally connected or formed at the first location and have been transported thereafter to the second location (for instance at the location of a filling station). In these situations it may occur that the discharge pipe 10 of the valve 4 is not in the proper position or mode (e.g. the storage position) for the receptacle to be filled and the filled receptacle to be handled further.

In all of these exemplary situations, it may be necessary to assure that the sealing device 1 is in the storage mode prior to the connection thereto of a protective cover and/or prior to assembly thereof on the drinking receptacle 50. In fact, during any of the aforementioned methods of joining the base 3 and the valve 4, it may be required to perform an additional step of urging the upstream seal member 12 into the storage position, irrespective of how the base 3, valve 4 and/or cap 61 are joined or are to be joined and how the base, valve and cap are delivered at the second location.

In order to both provide for a proper connection of the protective cap 61 to the sealing unit, to guarantee that the valve is in the storage position and to ensure that the base 3 and valve 4 are properly aligned relative to each other (especially if the base 3 and valve 4 are allowed to get misaligned, for instance to get slightly displaced relative to each other, for instance during transport and/or storage), a handling device 100 as defined herein may be provided. Referring to FIGS. 7A and 7B, a handling device 100 is shown for handling a sealing device 1. The handling device 100 comprises a sealing unit and a protective cap 61 loosely placed on top of the sealing unit. In the shown embodiment the handling device 100 comprises a stationary cap support 150 arranged at the downstream side of the protective cap 61 and configured to support the protective cap 61. The cap support 150 has a contact surface 151 having a shape adapted to the shape of protective cap 61 so that the cap 61 can be stably received in the cap support 150.

The handling device 100 further comprises a pushing device 120 arranged at the upstream side of the base 3. The pushing device 120 is configured to locally apply a first pushing force in axial downstream direction ($P_d$) on the base 3, for instance on the partition wall 31 of the base 3, in order to urge the base 3, the valve 4 connected to the base 3, and the protective cap 61 placed on the valve 4, against the cap support 150. The pushing device 120 is also configured to locally apply a second pushing force in the same axial downstream direction ($P_d$) on the discharge pipe 10 of the valve 4 in order to urge the discharge pipe 10 to move (or to stay) in its storage position.

In the embodiments shown in FIGS. 7A and 7B the pushing device 120 comprises a first pushing element 121 and a second pushing element 122, wherein the both the first and second pushing elements can be moved in axial direction relative to each other. The first pushing element 121 comprises a central elongated pushing rod and the second pushing element 122 comprises a tube that is arranged concentrically around the pushing rod. The pushing rod and tube are arranged to be axially movable relative to each other.

Referring to FIG. 7A, the second pushing element 122 in the shape of a tube may comprise an annular contact surface 124 to be placed against the base 3. Similarly, the central pushing rod may comprise a contact surface 123 adapted to the shape of the discharge pipe 10, preferably to the upstream seal member 12 thereof. In the specific embodiment shown in FIG. 7A, the pushing rod is comprised of a first pushing rod part 127 and an exchangeable second pushing rod part 128. The exchangeable second pushing rod part 128 can be replaced by another pushing rod part with a differently shaped contact surface, depending on the specific type of sealing device that is to be handled by the present handling device 100.

The first pushing element 121 is configured to apply a pushing force only on the movable discharge pipe of the valve 4 (i.e. directly or indirectly), while the second pushing element is configured to apply a force only on the stationary base and/or the stationary parts of the valve 4 (i.e. the housing of the valve). To this end the handling device 100 further comprises a drive 130. The drive 130 is configured to drive the movement of the first pushing element 121 and drive the movement of the second pushing element 122. The drive 130 (only schematically shown in the figures) could comprise one or more linear actuators, for instance an actuator of the rack and pinion type. In embodiments of the present disclosure (not shown) the drive 130 comprises a linear actuator for driving the movement of the first pushing element 121 and a separate linear actuator for independently driving the movement of the second pushing element 122. However, in the embodiments shown in FIGS. 7A and 7B, the drive 130 comprises a first drive unit (for instance a linear actuator) for applying an axial force 161 in upstream and/or downstream direction to cause a reciprocating axial movement of the first pushing element 121, while the second drive unit comprises at least one resilient member 135 connected between the first and second pushing elements 121,122 and configured to move the second pushing 122 element along with the movement of the first pushing element 121. The resilient member 135 may be a compression spring or similar device.

In operation, the sealing device 1 is placed in the handling device 10. In embodiments of the present disclosure, the protective cap 61 may have been placed loosely on top of the sealing unit comprises of the base 3 and valve 4 that have been connected to each other at an earlier stage. In other embodiments the base 3 and valve 4 have already been attached to the protective cap.

Then, in a first stage, the drive 130 applies a force 161 on the first pushing element 121 so that the first pushing element 121 moves in the direction of the sealing device 1. Because of the presence of the resilient member 135 between the first and second pushing elements 121,122, the second pushing element 122 is caused to co-move with the axial movement in downstream direction of the first pushing element 121 until the contact surface 124 of the second pushing element 122 abuts the base, as is shown in FIG. 7A.

In a second stage the drive 130 continues apply a force onto the first pushing element 121 in downstream direction. Because of the spring action of the resilient element 135 the second pushing element 122 is now pushes with a first force against the base 3 causing the base 3, valve 4 and cap 61 to be pressed on each other and urge the protective cap 61 against the cap support 150.

In a third stage the force exerted by the drive on the first element 121 is increased. This causes the first pushing element 121 to move towards the sealing device, against the counterforce provided by the resilient member 135, until the contact surface 123 of the first pushing element 121 reaches the end wall 12 of the discharge pipe 10 of the valve 4 and starts pushing against the discharge pipe 10. Depending on the current position of the valve, the discharge pipe 10 is moved towards the storage position (if the valve is not yet in the storage position) or is maintained in the storage position (of the valve is already in the storage position). In this manner it is ensured that the valve is arranged in the storage position.

As mentioned before, the cap support 150 and pushing device 120 can be used at the same time to actually attach a protective cover 61 that has been loosely placed on top of the sealing unit (i.e. the interconnected base 3 and valve 4) to at least one of the base 3 and valve 4. In embodiments of the present disclosure the base 3 and/or the cap 61 comprises clamping means (for instance including a couple of snap fit elements) to thereby attach the cap 61 on the sealing device 1, for instance in a click-like manner.

Further, in some embodiments, the handling device100 may be used simultaneously with other devices that are configured for gluing, heat welding, ultrasonic welding, RF welding, pressure welding and/or impact welding of the valve 4 and the base 3 as described above. For instance it may be preferable to place the valve 4 and base 3 into the handling device 100 and to join the valve 4 and the base 3 by ultrasonic welding while the base and valve are held in the handling device 100 while the upstream member 12 of the discharge pipe 10 of the valve 4 is substantially simultaneously brought into the storage mode.

The contact surface 123 of the first element 121 may have a shape, at least at the outermost portion thereof in the upward direction thereof, that is configured to exert a force in the upward direction ($P_d$) on the upstream seal member 12 only near the peripheral edge of the upstream seal member 12. For example, the part 128 as illustrated in FIGS. 7A and 7B may have an outer end (in the upward direction) having a generally hollow cylindrical shape. Thereby, since the upstream seal member 12 has an circularly symmetric shape, substantially no force is exerted (directly) on the center of the upstream seal member. As such, the force in the upward direction is exerted on the upstream seal member in such a manner that the upstream seal member is forced to move over the seal bulb of the base 3 of the sealing device 1. This may result in an even more reliable storage seal. On the other hand, if the force in the upward direction was exerted in the center of the upstream seal member, the shape of the seal member might deform in such a manner that the peripheral edge thereof is not forced over the seal bulb of the seal member but, for example, may deform in the center portion of the upward seal member 12 while not forcing the peripheral edge thereof beyond the seal bulb.

Figure 8:
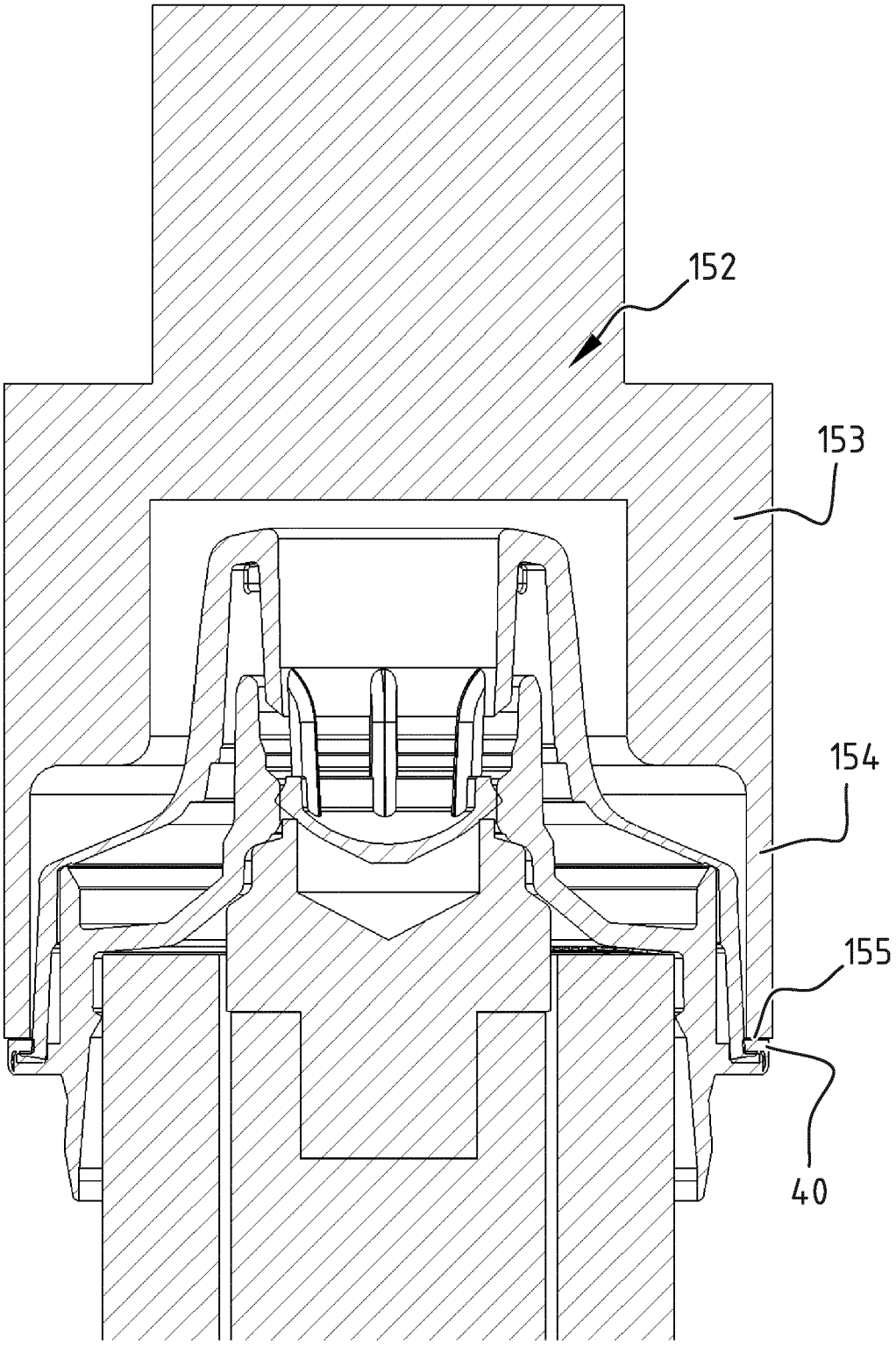
FIG. 8 longitudinal sectional view of another embodiment of a handling device, especially suitable for handling a sealing device without a protective cover.

FIG. 8 illustrates a further embodiment of a handling device according to the present disclosure. In this embodiment the handling device is particularly suited for handling sealing devices that have not been provided with a protective cover. The earlier described embodiment of FIGS. 7A and 7B relate to a handling device particularly suited for handling sealing devices that have a removable protective cap placed on top of the base/valve.

In the further embodiment the handling device comprises a stationary valve support 152 arranged at the downstream side of the valve and configured to support the valve 4. To this end the valve support 152 is shaped so as to have a circumferential flange 154 having a bottom circumferential edge 155 that is shaped to contact the clamping ring 40 and/or the valve collar 13 of the valve 4 so that the sealing device can be stably received in and supported by the cap support 152. FIG. 8 shows the handling device in the second position corresponding to the second position shown in FIG. 7B. The handling device can also be placed in the first position, similar to the first position shown in FIG. 7A.

As expressed above the terms "downward" and "upward" are only used for the sake of explanation due to the orientation of the FIGS. 7A, 7B and 8 and are not limiting. For example, the handling device100 may be arranged above the sealing device 1. In such a case the upward direction may be in the same direction as gravity while the downward direction is opposed to the direction of gravity. A person skilled in the art will recognize that any orientation with respect to the direction of gravity falls under the disclosure above, e.g. horizontal, vertical, oblique, any combination and/or any inversion thereof.

In embodiments of the present disclosure a camera system is provided, for instance positioned at the end of the assembly line, in order to check that the storage seal is in place. More particularly, camera is arranged to view the handling device from the upper side. The camera is directed to the molding inlet point and compares this circular point against the outer rim of the valve, also a circular rim. If these two circular details are concentric, then it is determined that the valve is in storage mode. If they are not concentric, it is determined that the valve is not in storage mode.

It is to be understood that this disclosure is not limited to particular aspects described, and, as such, may vary. It is also to be understood that the terminology used herein is for the purpose of describing particular aspects only, and is not intended to be limiting, since the scope of the present disclosure be limited only by the appended claims.

The invention claimed is:

1. A handling device for handling a sealing device for sealing a receptacle, the sealing device comprising:

a base structured to be mounted to the receptacle, the base comprising a sleeve forming a discharge conduit; and a valve including a valve housing arranged on the base, wherein when the base is mounted to the receptacle, the receptacle is located upstream of the valve and a discharge direction of the receptacle defines a downstream direction, opposite an upstream direction, wherein the valve further comprises a discharge pipe at least partially protruding in the sleeve of the base and being axially movable therein in the upstream direction and the downstream direction between a storage position in which the valve is closed and one more utility positions in which the valve is closed or opened;

wherein the handling device is configured to position the discharge pipe of the valve of the sealing device into the storage position, the handling device comprising:

a support to be arranged at a downstream side of the base and configured to support the handling device; and a pushing device to be arranged at an upstream side of the base and configured to apply a first pushing force on the base and/or on the valve housing to urge at least the base and the valve against the support and to apply a second pushing force on the discharge pipe of the valve to urge the discharge pipe to the storage position.

2. The handling device as claimed in claim 1, wherein the pushing device is configured to apply the first pushing force on the base independently from applying the second pushing force on the discharge pipe to displace the discharge pipe independently from a displacement of the base to the storage position.

3. The handling device as claimed in claim 1, further comprising:

a protective cap to be placed on the base and/or the valve for protecting the valve, wherein:

the support is a cap support arranged at a downstream side of the protective cap and configured to support the protective cap, and the pushing device is arranged at the upstream side of the base and configured to apply the first pushing force on the base and/or on the valve housing to urge the base, the valve and the protective cap against the cap support and to apply the second pushing force on the discharge pipe of the valve to urge the discharge pipe to the storage position.

4. The handling device as claimed in claim 3, wherein the protective cap further protects the base.

5. The handling device as claimed in claim 1, wherein:

the support is a valve support arranged at the downstream side of the valve and configured to support the valve, and the valve is arranged to contact a clamping ring and/or a valve collar.

6. The handling device as claimed in claim 1, wherein the handling device is configured to:

attach a protective cap to the valve and/or the base, and position the valve into the storage position.

7. The handling device as claimed in claim 1, wherein the pushing device is configured to apply the second pushing force on the discharge pipe that is larger than the first pushing force applied to the base and/or on the valve housing.

8. The handling device as claimed in claim 1, wherein:

the discharge pipe of the sealing device is configured to be axially movable between:

the storage position, an open utility position in which the discharge pipe has been moved in the upstream direction to open the discharge conduit, and a closed utility position in which the discharge pipe has been moved to contact a utility seal part of the sleeve to close the discharge conduit, in the storage position, the discharge pipe has been moved in the downstream direction to contact a storage seal seat of the sleeve to close the discharge conduit, the closed utility position is arranged between the storage position and the open utility position, and the handling device is configured to move the discharge pipe from the open utility position or the closed utility position to the storage position, and/or wherein the valve and the base are configured to allow movement of the discharge pipe between a closed storage position and a closed utility position in which the valve is closed in a more firm manner in the closed storage position than in the closed utility position.

9. The handling device as claimed in claim 1, wherein:

the discharge pipe comprises an upstream seal member, and the handling device is configured to contact the upstream seal member and to move the upstream seal member in the downstream direction until the discharge pipe reaches the storage position.

10. The handling device as claimed in claim 1, wherein:

the pushing device comprises:

a first pushing element comprising a first contact surface to be placed against the discharge pipe, and;

a second pushing element comprising a second contact surface to be placed against the base;

the first and second pushing elements are configured to be displaced relative to each other in an axial direction, and the handling device further comprises at least one of:

a drive configured to drive a movement of the first pushing element and drive a movement of the second pushing element, the drive comprising a first drive unit for driving the movement of the first pushing element and a second drive unit for driving the movement of the second pushing element independently from driving the first pushing element, or a drive comprising a first drive unit for driving the movement of the first pushing element and at least one resilient member connected between the first and second pushing elements and configured to move the second pushing element along the movement of the first pushing element.

11. The handling device as claimed in claim 10, wherein the drive is configured to:

in a first stage, have the second pushing element co-move with an axial movement of the first pushing element in the downstream direction until the second pushing elements abuts the base;

in a second stage, have the second pushing element apply a pushing force on the base to arrange the base, the valve and a protective cap against each other and urge the protective cap against a cap support, while continuing moving the first pushing element in the downstream direction; and in a third stage, have the first pushing element start pushing against the discharge pipe of the valve to bring the discharge pipe into the storage position.

12. The handling device as claimed in claim 10 wherein:

the first pushing element comprises an elongated pushing rod, and the second pushing element comprises a tube that is arranged concentrically around the elongated pushing rod and is axially movable relative to the elongated pushing rod, and/or the first pushing element comprises a first pushing rod part and an exchangeable second pushing rod part, the exchangeable second pushing rod part having a contact surface adapted to a shape of the discharge pipe.

13. The handling device as claimed in claim 12, wherein the contact surface adapted to the shape of the discharge pipe of the sealing device is adapted to an upstream seal member of the discharge pipe.

14. The handling device as claimed in claim 10, wherein the first contact surface is adapted to be placed against an upstream seal member of the discharge pipe.

15. An assembly of the handling device and at least one sealing device as claimed in claim 1.

16. A method of handling the sealing device in the handling device as claimed in claim 1, the method comprising:

placing the sealing device between a cap support and the pushing device of the handling device;

applying the first pushing force on the base and/or the valve housing of the sealing device to urge the base, the valve and a protective cap against the cap support; and applying the second pushing force on the discharge pipe of the valve to urge the discharge pipe to the storage position, wherein applying the first pushing force on the base is independent from applying the second pushing force on the discharge pipe to displace the discharge pipe independently from a displacement of the base to the storage position.

17. The method as claimed in claim 16, further comprising:

attaching a protective cap to the valve and/or the base, and positioning the valve into the storage position.

18. The method as claimed in claim 16, further comprising:

applying the second pushing force on the discharge pipe, wherein the second pushing force is larger than the first pushing force applied to the base and/or the valve housing.

19. The method as claimed in claim 16, wherein:

the discharge pipe of the sealing device is configured to be axially movable between:

the storage position, an open utility position in which the discharge pipe has been moved in the upstream direction to open the discharge conduit, and a closed utility position in which the discharge pipe has been moved to contact a utility seal part of the sleeve to close the discharge conduit, in the storage position, the discharge pipe has been moved in the downstream direction to contact a storage seal seat of the sleeve to close the discharge conduit, the closed utility position is arranged between the storage position and the open utility position, and wherein the method further comprises moving the discharge pipe from the open utility position or the closed utility position to the storage position.

20. The method as claimed in claim 16, wherein:

when the discharge pipe comprises an upstream seal member, the method further comprises contacting the upstream seal member and moving the upstream seal member in the downstream direction until the discharge pipe reaches the storage position, or when the pushing device comprises a first pushing element comprising a first contact surface and a second pushing element comprising a second contact surface, the method further comprises:

moving the second pushing element towards the base of the sealing device and having the second contact surface of the second pushing element apply a pushing force against the base, and moving the first pushing element towards the discharge pipe of the sealing device and having the first contact surface of the first pushing element apply a pushing force against the discharge pipe, wherein the first pushing element and the second pushing element are displaced relative to each other in an axial direction.

21. The method as claimed in claim 16, wherein:

the pushing device comprises a first pushing element comprising a first contact surface and a second pushing element comprising a second contact surface, and the method further comprises driving a movement of the first pushing element and driving a movement of the second pushing element using a drive connected to the pushing device.

22. The method as claimed in claim 21, further comprising:

driving the movement of the first pushing element independently from driving the movement of the second pushing element.

23. The method as claimed in claim 16, further comprising:

aligning the base and the valve housing by applying the first pushing force.

* * * * *